US011313145B2

(12) United States Patent
Noori et al.

(10) Patent No.: US 11,313,145 B2
(45) Date of Patent: Apr. 26, 2022

(54) EARTHQUAKE PROTECTION SYSTEMS, METHODS AND APPARATUS USING SHAPE MEMORY ALLOY (SMA)-BASED SUPERELASTICITY-ASSISTED SLIDER (SSS)

(71) Applicant: Cal Poly Corporation, San Luis Obispo, CA (US)

(72) Inventors: Mohammad Noori, San Luis Obispo, CA (US); Peyman Narjabadifam, East Azerbaijan (IR)

(73) Assignee: Cal Poly Corporation, San Luis Obispo, CA (US)

( * ) Notice: Subject to any disclaimer, the term of this patent is extended or adjusted under 35 U.S.C. 154(b) by 0 days.

(21) Appl. No.: 17/020,824

(22) Filed: Sep. 15, 2020

(65) Prior Publication Data

US 2022/0081925 A1 Mar. 17, 2022

(51) Int. Cl.
*E04H 9/02* (2006.01)

(52) U.S. Cl.
CPC ..... *E04H 9/021* (2013.01)

(58) Field of Classification Search
CPC ..... E04H 9/021; E04H 9/0237; E02D 27/34; E04B 1/98
See application file for complete search history.

(56) References Cited

U.S. PATENT DOCUMENTS 5,669,189 A * 9/1997 Logiadis ..... E04H 9/021 52/167.4
5,727,391 A * 3/1998 Hayward ..... B25J 9/1085 248/636
2005/0138870 A1* 6/2005 Ishimura ..... E04H 9/0237 52/167.1
2015/0159370 A1* 6/2015 Ruan ..... E02D 27/34 52/167.4
2015/0184413 A1* 7/2015 Pryor ..... E04C 3/04 52/167.3
2015/0191928 A1* 7/2015 Germain ..... E04H 9/021 52/167.7
2017/0204603 A1* 7/2017 Tsai ..... E04H 9/022
2020/0002966 A1* 1/2020 Colenso ..... E02D 27/34
2020/0355166 A1* 11/2020 Mortensen ..... F16F 15/022
2021/0054962 A1* 2/2021 Masek ..... F16F 7/128

FOREIGN PATENT DOCUMENTS

CN 204626245 U * 9/2015

* cited by examiner

*Primary Examiner* — Theodore V Adamos
(74) *Attorney, Agent, or Firm* — George B. Leavell

(57) ABSTRACT

A system and method of isolating a building structure from ground movement including centering a building structure in a first position relative to a building foundation, securing a first portion of a super-elastic slider system (SSS) to the foundation, securing a second portion of the SSS to the structure. The SSS includes at least one shape metal alloy (SMA) element extending between the first portion and the second portion. The at least one SMA element having an initial shape. Moving the foundation during a ground movement and shifting the structure in at least one of a horizontal and a vertical direction to a second position, including flexing the at least one SMA element to a secondary shape, and automatically recentering the structure to the first position including retracting the at least one flexed SMA element to the initial shape.

22 Claims, 23 Drawing Sheets

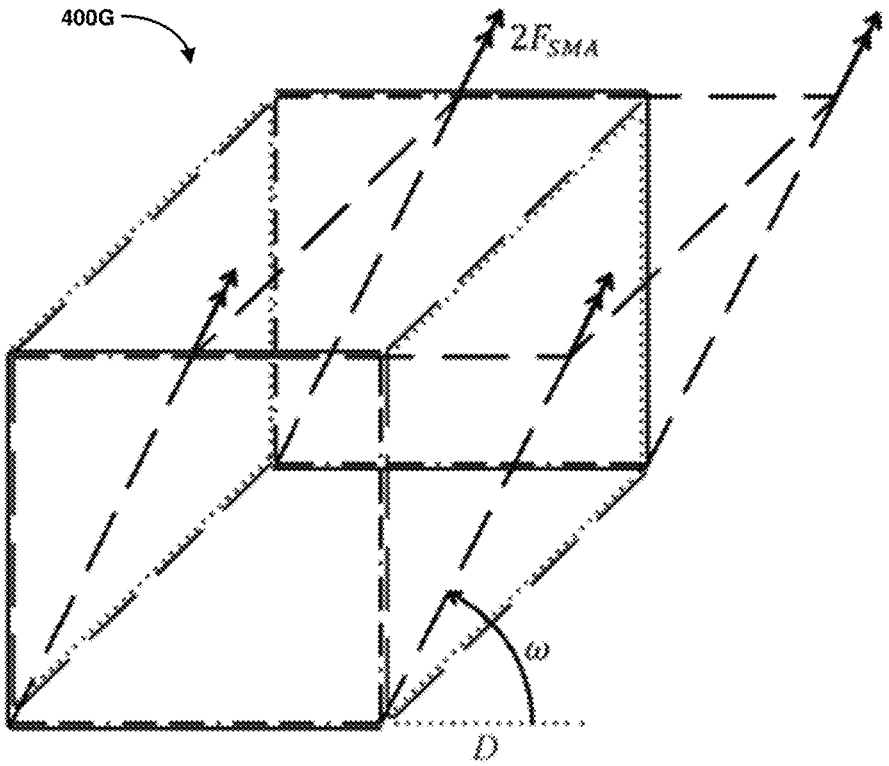

FIG. 4G $$F_{SMAs} = \begin{cases} \text{C: } 0.25\pi n_c n_w \phi^2 \sigma_{SMA} \\ \text{I: } \pi n_i n_w \phi^2 \sigma_{SMA} \end{cases}$$

$$F_{FSBs} = \begin{cases} \text{C: } \mu(W + F_{SMAs} \sin\theta) \\ \text{I: } \mu\left(\sum_{j=1}^{n_i} W_j + F_{SMAs} \sin\theta\right) \end{cases}$$

$$\phi = \begin{cases} \text{C: } \sqrt{\dfrac{\Gamma - X}{\pi^2 g n_c n_w (\Psi + \Omega) D_d \hat{\sigma}_{SMA}} \sum_{j=1}^{n_f} W_j} \\ \text{I: } \sqrt{\dfrac{\Gamma - X}{4\pi^2 g n_i n_w (\Psi + \Omega) D_d \hat{\sigma}_{SMA}} \sum_{j=1}^{n_i} W_j} \end{cases}$$

F: Force
I: IU-based modern style of construction
$\boldsymbol{D}$ | $\boldsymbol{D_d}$: Displacement | Its design value
$\boldsymbol{n_c}$: number of cables (*assumed*)
$\boldsymbol{n_w}$: number of wires in cables (*layout*)
$\boldsymbol{\phi}$: The diameter of each wire
$\boldsymbol{\sigma}$: stress
$\boldsymbol{n_i}$: number of isolators (*assumed*)
$\boldsymbol{W}$: Weight
$\boldsymbol{\Gamma} = 12.5 a_g^2 S^2 T_C^2$
$\boldsymbol{X} = 4\pi g(40 + \pi)\mu D_d$
$\boldsymbol{\Psi} = (16 + \pi)\mu \sin\hat{\theta}$
$\boldsymbol{\Omega} = \pi(1 + 20\zeta_{SMA}) \cos\hat{\theta}$
$\boldsymbol{a_g}, \boldsymbol{S}, \boldsymbol{T_C}$: code-based spectral properties
$\boldsymbol{\zeta}$ | $\hat{\boldsymbol{\theta}}$: damping ratio | The minimum $\theta$

FIG. 4H

EARTHQUAKE PROTECTION SYSTEMS, METHODS AND APPARATUS USING SHAPE MEMORY ALLOY (SMA)-BASED SUPERELASTICITY-ASSISTED SLIDER (SSS)

FIELD OF THE DISCLOSURE

The present disclosure relates generally to systems and methods for aseismic controlling of structures, and more particularly, to systems, methods and apparatus for isolating structures from seismic actions during an earthquake.

BACKGROUND

Earthquake prone locales typically require some type of control system to reduce damage to the structure incurred during an earthquake. Seismic isolation between the structure of a building and the foundation of the building is a useful system. The isolation systems allow the structure to shift from an original position to one or more horizontally offset positions, relative to the foundation, when an earthquake occurs. Allowing the structure to shift horizontally during an earthquake significantly reduces the forces applied to the structure caused by the earthquake.

Typical isolation systems include elastomeric, sliding and other types of bearings. Low damping laminated rubber bearings, high damping laminated rubber bearings, flat sliding bearings and friction pendulum systems are the most common used isolators. Different types of isolators can be used in combination to provide additional isolation performance.

Available aseismic isolation systems have not been able to result in widespread and effective application of aseismic isolation strategy in construction practice. This is unfortunate as earthquakes occur frequently and continue to cause many complex problems in our societies, while aseismic isolation can provide more sustainable earthquake resilience. Advanced materials can be used with effective engineering techniques to provide practical solutions. It is in this context that the following embodiments arise.

SUMMARY

Broadly speaking, the present disclosure fills these needs by providing earthquake protection systems, methods and apparatus using shape memory alloy (SMA)-based superelasticity-assisted slider (SSS) which allows the structure of a building to be isolated effectively from damaging motions of underlying ground during an earthquake and shift back to the original position after the earthquake has ended. It should be appreciated that the present disclosure can be implemented in various types of structures and in numerous ways, including as a process, an apparatus, a system, computer readable media, or a device. Several inventive embodiments of the present disclosure are described below.

At least one implementation provides a construction industry friendly framework, which can result in the widespread practical application of aseismic isolation to provide effective earthquake protection of building structures. Alternative configurations are disclosed for versatile, effective and practical applications. Many types of complex force displacement hysteresis can be designed for a specific project by using one or more of the alternative configurations and the respective geometric variants.

In at least one implementation, the disclosed shape memory alloy (SMA)-based superelasticity-assisted slider (SSS) can be compatible with modern isolation unit (IU)-based applications and in IU-less type of construction applications. The SMA-based SSSs provide advantages of improved integrity, redundancy, performance, systematic design and construction. The SMA-based SSSs can utilize cables or wire ropes instead of wire bundles or bars. The wire bundles can also be utilized within the SMA-based SSS systems with correct restrainers. Improved maintainability, owing to the well-known unique properties of SMAs.

In at least one implementation, the modularity of the SMA-based SSSs provide additional advantages in the construction industry including maintainability and replaceability of isolating and recentering elements, resulting in a reduced maintenance cost. The reduced maintenance cost leads to more resilient and effective earthquake protection.

At least one implementation includes a method of isolating a building structure from a ground movement including centering the building structure in a first position relative to a building foundation, securing a first portion of a super-elastic slider system to the building foundation and securing a second portion of the super-elastic slider system to the building structure. The super-elastic slider system can include at least one shape metal alloy element extending between the first portion of the super-elastic slider system and the second portion of the super-elastic slider system. The at least one shape metal alloy element has an initial shape. The building foundation moves during the ground movement and the building structure shifts in at least one of a horizontal direction and a vertical direction to a second position relative to the building foundation. Shifting the building structure to the second position includes flexing the at least one shape metal alloy element to a secondary shape. The building structure automatically recenters to the first position, including retracting the at least one flexed shape metal alloy element to the initial shape.

The at least one shape metal alloy element can include multiple shape metal alloy elements. The multiple shape metal alloy elements can be arrayed in two parallel planes. The multiple shape metal alloy elements can be arrayed in at least one first plane and at least one second plane perpendicular to and intersecting with the at least one first plane.

The at least one shape metal alloy element can extend through two or more intersecting perpendicular planes. The at least one shape metal alloy element can extend through and between two or more parallel planes. The at least one shape metal alloy element can extend along an intersection of two intersecting perpendicular planes.

The at least one shape metal alloy element can extend diagonally across a single plane. The at least one shape metal alloy element can extend along one or more edges of a perimeter of a single plane.

Another implementation can provide super-elastic slider system comprising at least one shape metal alloy element extending between a first portion of the super-elastic slider system and a second portion of the super-elastic slider system, the at least one shape metal alloy element having an initial shape, wherein the first portion of the super-elastic slider system being capable of being attached to a building foundation and second portion of the super-elastic slider system being capable of being attached to a building structure.

Other aspects and advantages of the disclosure will become apparent from the following detailed description, taken in conjunction with the accompanying drawings, illustrating by way of example the principles of the disclosure.

BRIEF DESCRIPTION OF THE DRAWINGS

The present disclosure will be readily understood by the following detailed description in conjunction with the accompanying drawings.

FIGS. 4A-H are graphs of a working principle of the superelasticity-assisted slider system, for implementing embodiments of the present disclosure.

DETAILED DESCRIPTION

Several exemplary embodiments for earthquake protection systems, methods and apparatus using shape memory alloy (SMA)-based superelasticity-assisted slider system (SSS) which allows the structure of a building be effectively isolated from damaging motions of the underlying ground during an earthquake, and shift back to the original position after the earthquake has ended, will now be described. It will be apparent to those skilled in the art that the present disclosure may be practiced without some or all of the specific details set forth herein.

Shape memory alloy (SMA)-based recentering is a new approach to recentering flat sliding bearings in isolation systems. Super elasticity provides large strain plateaus, acceptable energy dissipation capacity, high fatigue resistance and corrosion resistance are the most favorable characteristics of austenitic SMAs for use in isolation systems. SMA-based superelasticity-assisted slider system (SSS) as described herein utilizes simple structured application of SMA cables to practically provide self-centering capability for FSBs. SSS utilizes the advantages of both sliding isolation and SMA-based re-centering. SMA-based SSS can improve the earthquake damage resistant performance of structures, while also protecting nonstructural elements and equipment from earthquake related damage. The simple and practical structure of SSS, is compatible with all isolation systems and will encourage structural designers and property owners to further implement isolation system technology, thus improving structural integrity and safety.

The superelasticity-assisted slider system (SSS) can be implemented in multiple different implementations. The different implementations include vertical (SSS-v), diagonal (SSS-d), horizontal (SSS-h), O-shaped (SSS-o), L-shaped (SSS-l), U-shaped (SSS-u) and C-shaped (SSS-c) arrangements of the SMA cables. The effectiveness of SSS is more than typical earthquake isolation systems owing to superiorities of both FSB's and SMA's and controlling the earthquake responses of structures. All of the configurations are described in the figures below illustrating the arrangement of cables in each configuration.

During an earthquake, the sliding mechanism in FSBs occur simultaneously with the elongation of SMA cables. The superelastic nature of the SMA cables provide the cell recentering capability while also increasing energy damping capacity. These effects cause a minimum reduction in the isolation capability because the elongation of the SMA cables occurs with a strain plateau specific to superelastic SMAs. The various different implementations of the SMA cables result in various forms of the strain plateau affected by the level of geometric nonlinearity corresponding to the different implementations. All details associated with the geometric nonlinearities of the alternative implementations are included in the structural design.

Figure 1A:
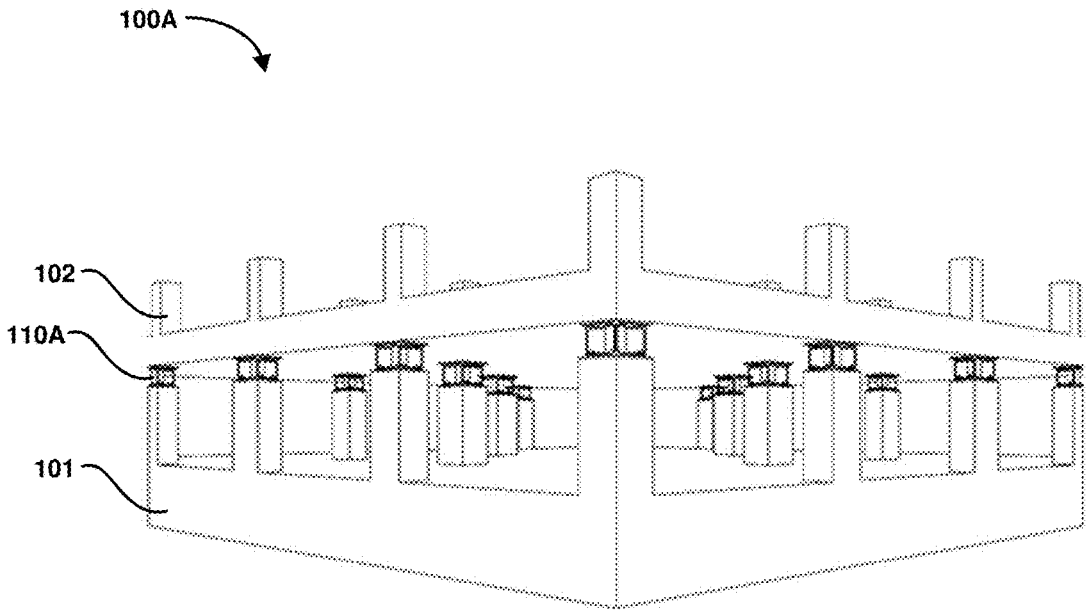
FIGS. 1A and 1B are simplified schematic diagrams of building structures including isolation systems for implementing embodiments of the present disclosure, respectively, in isolation unit (IU)-based and IU-less construction applications.
Figure 1B:
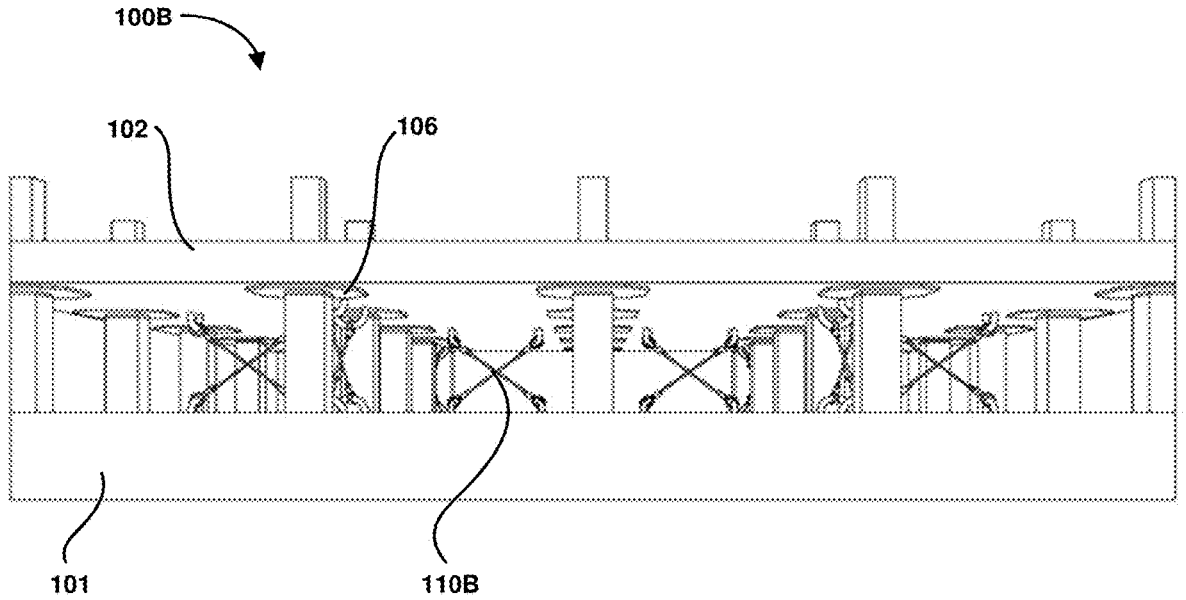

FIGS. 1A and 1B are simplified schematic diagrams of building structures 100A, 100B including isolation systems for implementing embodiments of the present disclosure. FIG. 1A illustrates the building foundation 101 supporting the building structure 102 through an isolation system including multiple isolation units 110A. Each of the isolation units 110A includes one or more of the SMA-based superelasticity-assisted slider system (SSS). FIG. 1B illustrates the building foundation 101 supporting the building structure 102 through an isolation system including multiple SMA-based (SSS) isolation systems 110B installed between the foundation and the structure. Flat slide bearings 106 are also shown. It should be understood that each of the isolation units 110A and the multiple SMA-based superelasticity-assisted slider system (SSS) isolation systems 110B can be any of the disclosed implementations of the SMA-based superelasticity-assisted slider system (SSS) isolation systems.

Figure 1C:
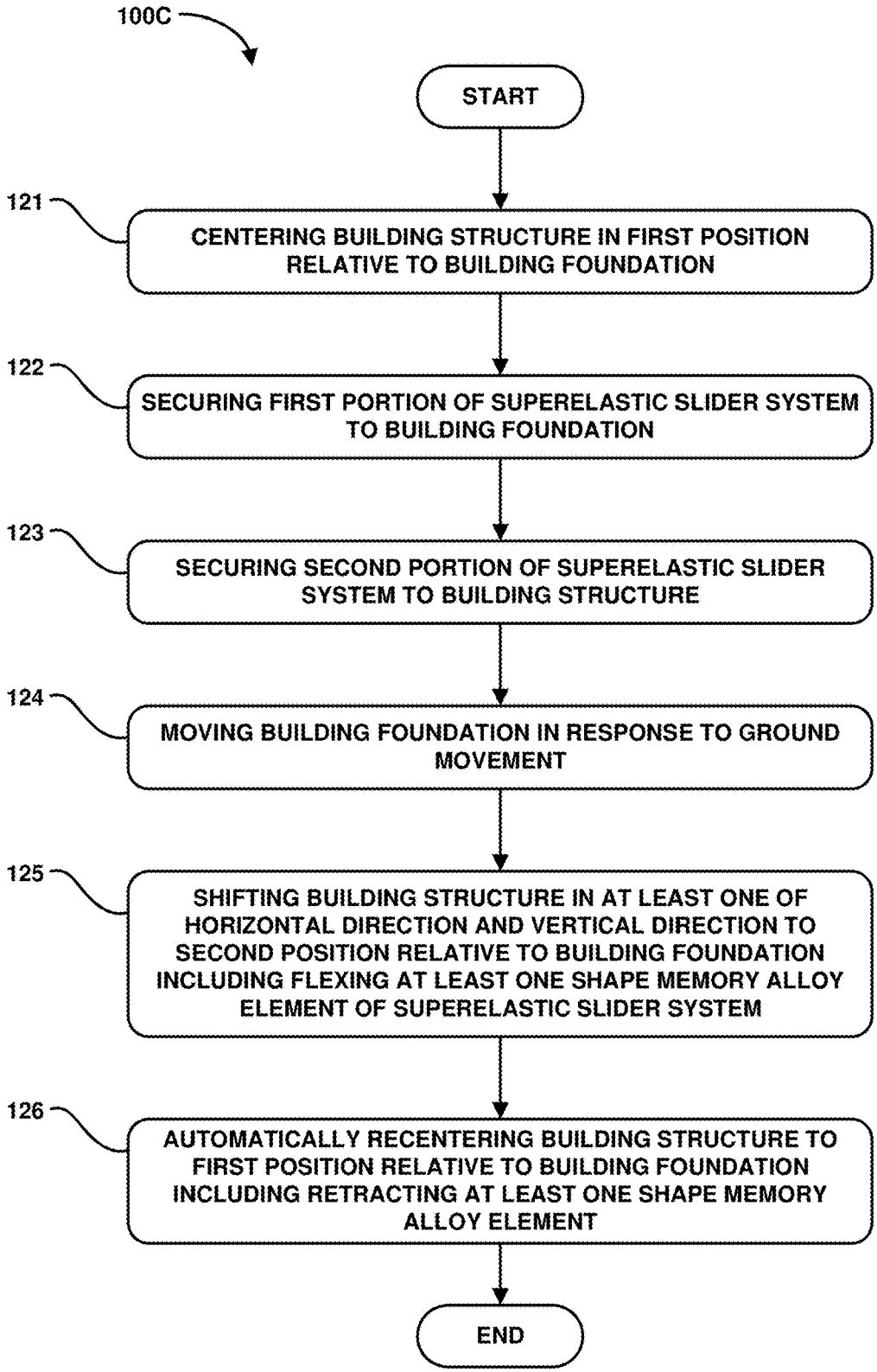
FIG. 1C is a flowchart diagram that illustrates the method operations performed in isolating a building structure from ground movement using a superelasticity-assisted slider system, for implementing embodiments of the present disclosure.

FIG. 1C is a flowchart diagram 100C that illustrates the method operations performed in isolating a building structure from ground movement using a superelasticity-assisted slider system, for implementing embodiments of the present disclosure. The operations illustrated herein are by way of example, as it should be understood that some operations may have sub-operations and in other instances, certain operations described herein may not be included in the illustrated operations. With this in mind, the method and operations 100C will now be described.

Figure 1D:
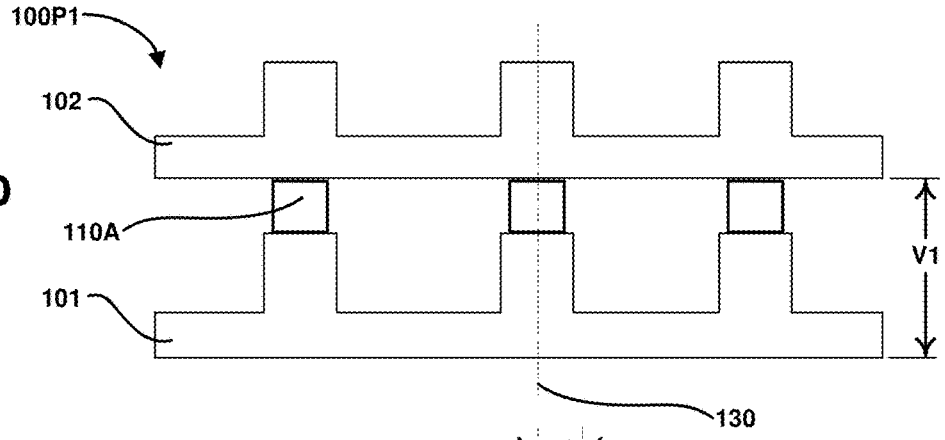
FIG. 1D is a simplified schematic diagram of building structures including isolation systems for implementing embodiments of the present disclosure.

In a method operation 121, the building structure 102 is centered on the building foundation 101, in a first position. FIG. 1D is a simplified schematic diagram of building structure 100P1 including isolation systems for implementing embodiments of the present disclosure. As shown in FIG. 1D, the isolation system 110A includes one or more super-elastic slider system (SSS) including one or more shape memory alloys (SMAs). FIG. 1D shows the building structure 102 in a first position, relative to the building foundation 101. In the first position, the building foundation 101 and the building structure share a common centerline 130 and the building structure is a first vertical distance V1 from the base of the building foundation.

The super-elastic slider system SSS 110A is installed in the building 100P1. The SSS can be installed directly between the building foundation 101 and the building structure 102, or alternatively, or in combination with isolation units.

In a method operation 122, a first portion of the SSS is secured to the building foundation 101. The first portion of the SSS can be secured to the building foundation 101 through any suitable means. By way of example, bolts or anchors or hinging rings or suitable equivalents and combinations thereof can be bolted to the foundation or cast into the foundation, such as in a concrete foundation.

In a method operation 123, a second portion of the SSS is secured to the building structure 102. The second portion of the SSS can be secured to the building structure 101 through any suitable means. By way of example, bolts or anchors or hinging rings or suitable equivalents and combinations thereof can be bolted to the building structure or cast into the building structure, such as in a concrete building structure.

As described elsewhere herein, the SSS isolates the building structure 102 from movement of the ground, as may occur during events such as an earthquake, or other ground movements and vibrations. In a method operation 124, a ground movement event occurs and the building foundation 101 moves due to the ground movement event.

The building foundation 101 moves due to a ground movement event and the SSS isolates the movement of the building foundation from the building structure 102. In a method operation 125, the building structure shifts relative to the building foundation in one or more of a horizontal direction and a vertical direction and combinations thereof, to a second position relative to the building foundation. Typically, V3-V1 is smaller than H2. By way of example, less than about 2-5 centimeters for V3-V1 as compared to about 50 centimeters for H2, in a typical multi-story building application. A typical multi-story building application with an isolation system having a horizontal to vertical period ratio of about 3 to 4 which is a practical range. It should be noted that V3-V1 relates nonlinearly to H2 and increases slightly for lighter and/or stiffer structures such as some equipment but reduces with a higher rate as the flexibility increases. One or more SMAs are flexed (e.g., stretched) out of an initial programmed shape to a secondary shape, when the building structure 102 shifts to the second position, relative the building foundation 101. The initial programmed shape is formed when the SMAs are installed in the isolation unit structure.

Figure 1E:
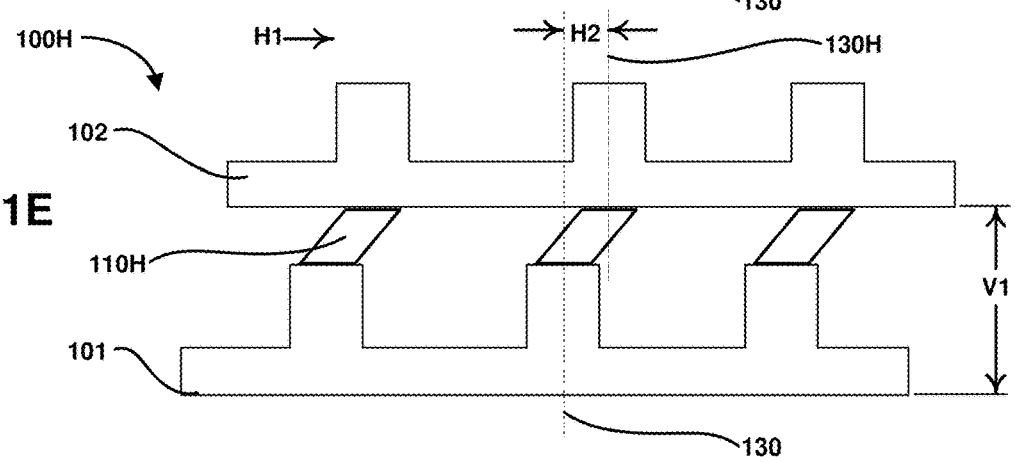
FIG. 1E is a simplified schematic diagram of a building structure having shifted in a horizontal direction H1, for implementing embodiments of the present disclosure.
Figure 1F:
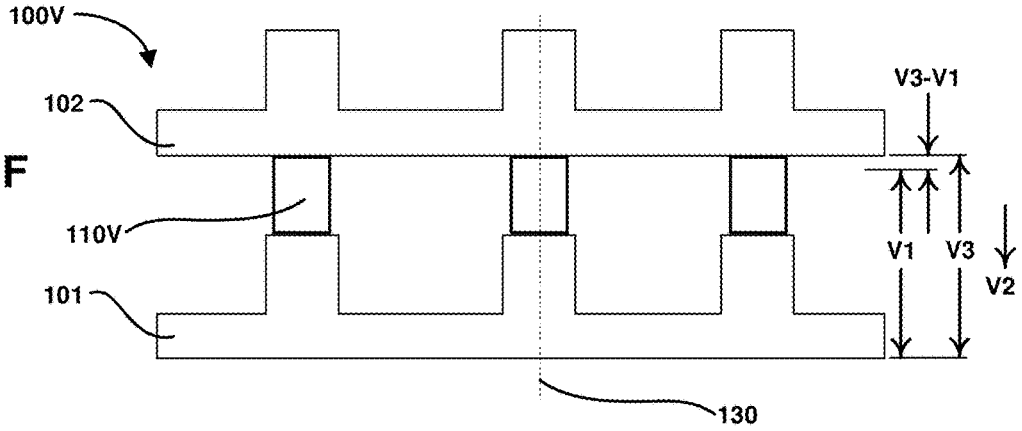
FIG. 1F is a simplified schematic diagram of a building structure having shifted in a vertical direction V2, for implementing embodiments of the present disclosure.

FIG. 1E is a simplified schematic diagram of a building structure 100H having shifted in a horizontal direction H1, for implementing embodiments of the present disclosure. In a non-limiting example, the building foundation 101 can move horizontally, in one or more directions (e.g., left, right, forward and/or aft and combinations thereof) and in one or more movements, due to movement of the ground. In this instance, building structure 102 has shifted to a second position that is a direction H1 and shifted a distance H2 from the first position shown in FIG. 1D. In the second position, the centerline 130H, of the building structure 102, is offset the distance H2 from the centerline 130 of the building foundation 101. The building structure 102 can remain substantially stationary in space, however, relative to the now moved building foundation, the building structure shifts to the second position, relative to the building foundation. As shown, the isolation system 110H is flexed in the horizontal direction H1. FIG. 1F is a simplified schematic diagram of a building structure 100V having shifted in a vertical direction V2, for implementing embodiments of the present disclosure. In another non-limiting example, the building foundation 101 can move vertically, in one or more directions (e.g., up and/or down and combinations thereof) and in one or more movements, due to movement of the ground. In this instance the building foundation mode downward in a direction V2 so that the building structure 102 is now a distance V3 from the base of the building foundation. The building structure 102 can remain substantially stationary in space, however, relative to the now moved building foundation, the building structure shifts to the second position, relative to the building foundation. As shown, the isolation system 110V is flexed in the vertical direction V2.

Figure 1G:
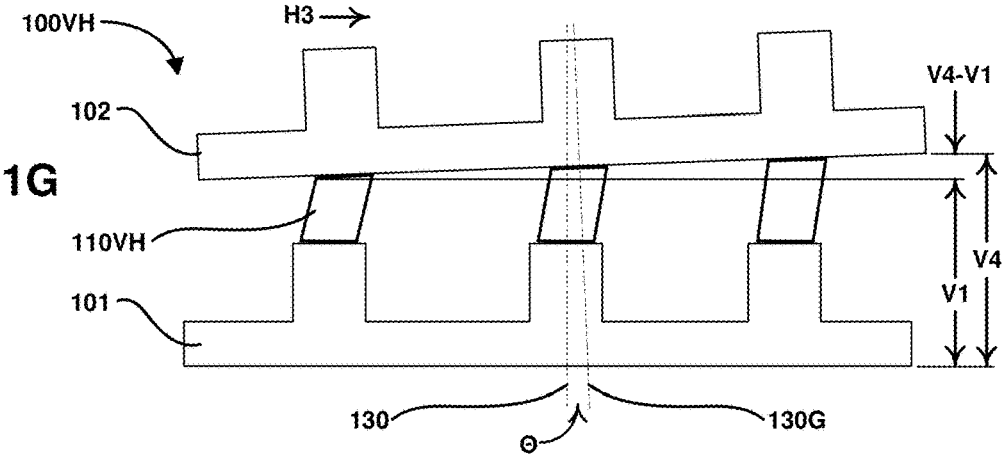
FIG. 1G is a simplified schematic diagram of a building structure having shifted in both horizontal and vertical directions for implementing embodiments of the present disclosure.

FIG. 1G is a simplified schematic diagram of a building structure 100VH including isolation systems for implementing embodiments of the present disclosure. In yet another non-limiting example, the building foundation 101 can move both vertically and horizontally, in one or more directions (e.g., left, right, forward, aft, up and/or down and combinations thereof) and in one or more movements, due to movement of the ground. The building structure 102 can remain substantially stationary in space, however, relative to the now moved building foundation, the building structure shifts to the second position, relative to the building foundation that is both shifted horizontally and vertically as shown. The isolation systems 110VH are flexed in both horizontal and vertical directions such that one end of the building structure is a distance V1 from the base of the building foundation and the opposite end of the building structure is a distance V4 from the base of the building foundation and the centerline 130G of the structure is offset at an angle θ to the centerline 130 of the foundation. The angle θ depends principally on structural parameters such as vertical irregularity caused by eccentricity of the center of mass of the superstructure of the building structure from a center of rigidity of the isolation system. Angle θ is a relation between horizontal and vertical periods of isolation in a practical range. The angle θ and related rocking displacements in any case can effectively be controlled by SSS, owing to the restraining effects of the SMA cables used specifically within the different configurations of the system.

SMAs are programmed to resist flexing from their initially programmed shape and to automatically return to their initially programmed shape when there are no forces present to cause them to flex out of their initial programmed shape. The forces are no longer present when the ground movement event ends.

In an operation 126, the one or more flexed SMA element automatically returns to the initial programmed shape from the secondary shape. The one or more flexed SMA element retracts or returns to the initial programmed shape automatically and substantially recenters or otherwise moves or shifts the building structure 102 from the second position, back to the first position. By way of examples, the building structure 102 is substantially moved back in to the first position, as shown in FIG. 1D, as the SMA element(s) retract.

Figure 2A:
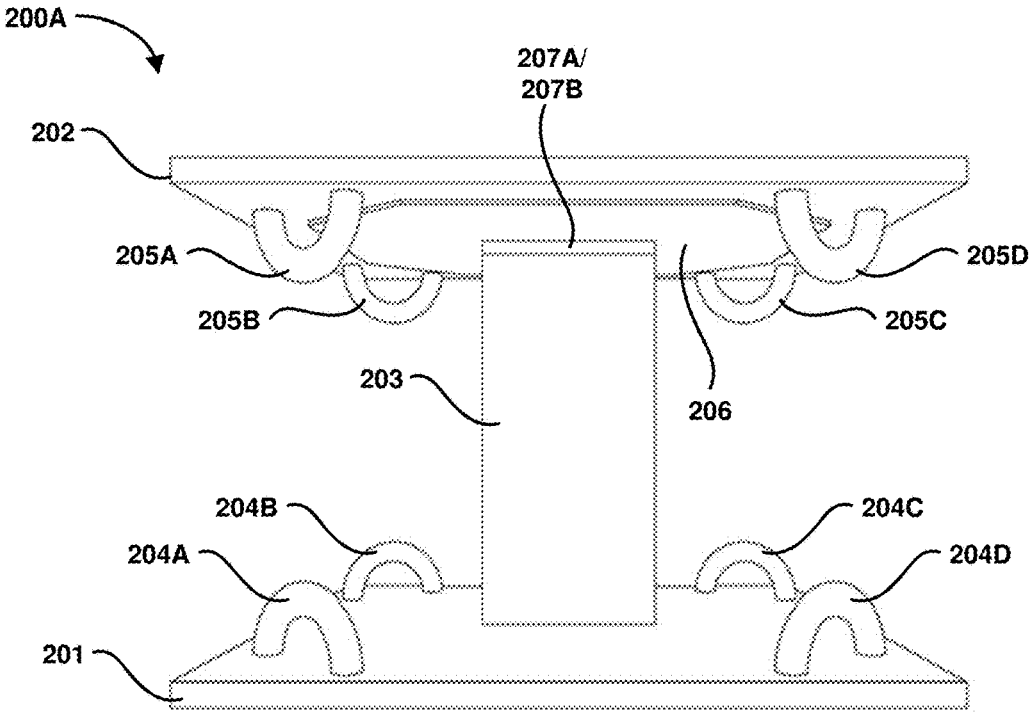
FIG. 2A is a schematic diagram of an exemplary isolation unit structure, for implementing embodiments of the present disclosure.
Figure 2B:
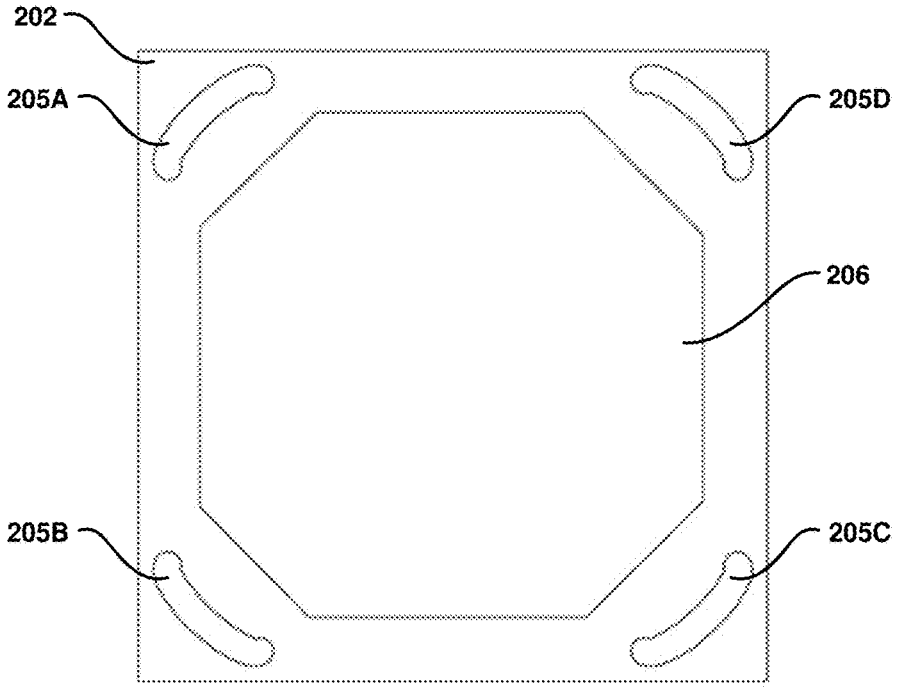
FIG. 2B is a bottom view of an exemplary top plate of an isolation unit structure, for implementing embodiments of the present disclosure.

FIG. 2A is a schematic diagram of an exemplary isolation unit structure 200A, for implementing embodiments of the present disclosure. FIG. 2B is a bottom view of an exemplary top plate 202 of an isolation unit structure 200A, for implementing embodiments of the present disclosure. A top view of an exemplary bottom plate 201 substantially similar to exemplary top plate 202 without the plate 206.

The isolation unit structure 200A includes a bottom plate 201 and a top plate 202. Between the bottom plate and the top plate is a pier 203 and a flat bearing system including one or more of pads 206 and 207A or 207B. As shown in FIG. 1A, the isolation unit 200A can be installed in one of the isolation unit locations 110A. The bottom plate 201 rests on the foundation of the building being supported in the building structure rests on top of the top plate 202. The pier 203 and the pads 206 and 207A or 207B, supports the weight of the structure between the bottom plate and the top plate. Each of the bottom plate and the top plate also include multiple hinging rings 204A-D and 205A-D, respectively. The bottom plate 201, top plate 202 and pier 203 can be formed from acceptable strength structure steel alloys, stainless steel alloys and combinations thereof. The bottom plate 201, top plate 202 and pier 203 can be welded or otherwise bonded together as applicable to a given application.

In at least one implementation, the pier 203 is solidly mounted to the bottom plate 201. In at least one implementation the pads 206, 207A, 207B are formed of a material that allows the top plate 202 to slide horizontally relative to the pier 203. Example materials for the pad 206 can include steel, stainless steel and similar metals and alloys thereof and combinations thereof for the bottom plate 201, top plate 202, pier 203 and hinging rings 204A-D and 205A-D. In at least one implementation, one or more of the pad 206, the bottom plate 201, top plate 202, pier 203 can be formed from a polished steel or stainless steel with various roughness types. Once type of stainless steel is a mirror-polished stainless steel referred to as SUS. A range for the roughness of SUS can be between about 0.03 μm to about 0.6 μm on the arithmetic average scale (Ra). Rougher stainless-steel surfaces of roughness up to 50 μm can also be used in certain applications.

Figure 2C:
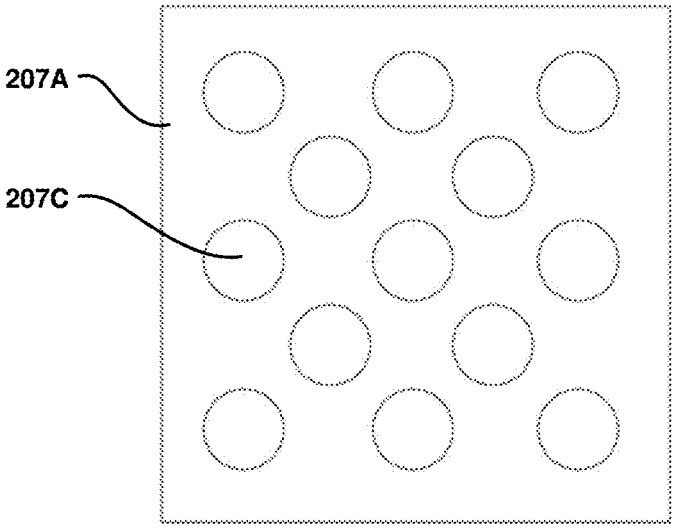
FIGS. 2C and 2D are schematic views exemplary pads of an isolation unit structure, for implementing embodiments of the present disclosure.
Figure 2D:
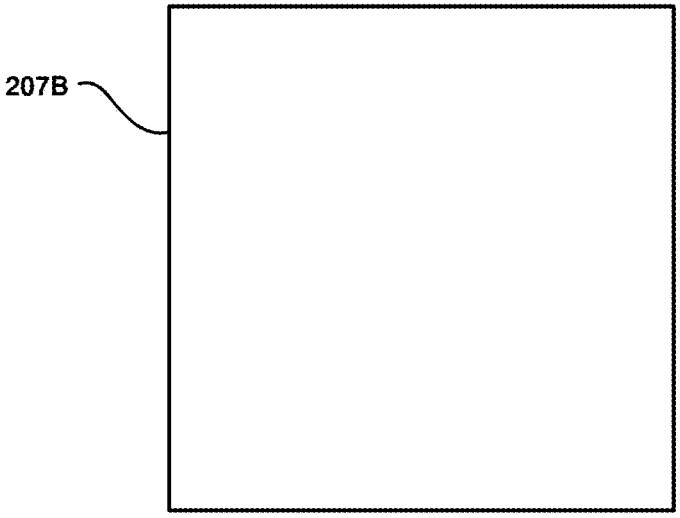

FIGS. 2C and 2D are schematic views exemplary pads 207A, 207B of an isolation unit structure 200A, for implementing embodiments of the present disclosure. The pad 207A includes multiple holes 207C. The holes 207C allow a lubricant to be stored within the pad 207A. The pad 207B is a solid pad without holes for non-lubricant implementations. Example materials for the pads 207A, 207B can include material such as non-metallic elastoplastic materials including cast nylon, polytetrafluoroethylene (PTFE), self-lubricating materials including polyethyleneterephtalate (PET) and similar materials and combinations thereof and metallic materials such as bronze. The pads 207A, 207B can be any suitable dimensions. By way of example, the pads can be between about 5 mm and about 20 mm thick. The holes 207C can be fully penetrating the pad 207A or only partially formed into the surface of the pad. By way of example, the holes 207C can be between about 2 mm to about 3 mm deep to fully penetrating through the pad. In one implementation, the holes 207C can be any suitable diameter and shape and depth. The thickness and number and arrangement and side of the holes can vary for the specific application. The lubricant used with the pads 207A can be any suitable lubricant including silicon-based grease and similar lubricants typically used in structural bearings.

The superelasticity-assisted slider system (SSS) can be implemented in multiple different implementations. The different implementations include vertical (SSS-v), diagonal (SSS-d), horizontal (SSS-h), O-shaped (SSS-o), L-shaped (SSS-l), U-shaped (SSS-u) and C-shaped (SSS-c) arrangements of the SMA cables. The effectiveness of SSS is more than typical earthquake isolation systems owing to superiorities of both FSBs and SMAs and controlling the earthquake responses of structures. All of the configurations are described in the figures below illustrating the arrangement of cables in each configuration.

FIGS. 3A-D are views of the vertical superelasticity-assisted slider system (SSS-v) implementations 300A-D, for implementing embodiments of the present disclosure. The SSS-v implementation 300A is for installation in a traditional construction building. Bottom hinging rings 204A-D are secured to the foundation of the building and top hinging rings 205A-D are secured to the structure of the building. SMA cables 301A-D extend in one or more vertical planes as shown and between and secured to the respective bottom and top hinging rings, as shown.

The SSS-v implementations 300B, 300C and 300D are for installation in an isolation unit that can be installed between the foundation and structure of the building, as shown in FIG. 1A. In SSS-v implementation 300B, the bottom hinging rings 204A-D are secured to the bottom plate 201 and the top hinging rings 205A-D are secured to the top plate 202. SMA cables 301A-D extend in one or more vertical planes as shown and between and secured to the respective bottom and top hinging rings, as shown.

Figure 3A:
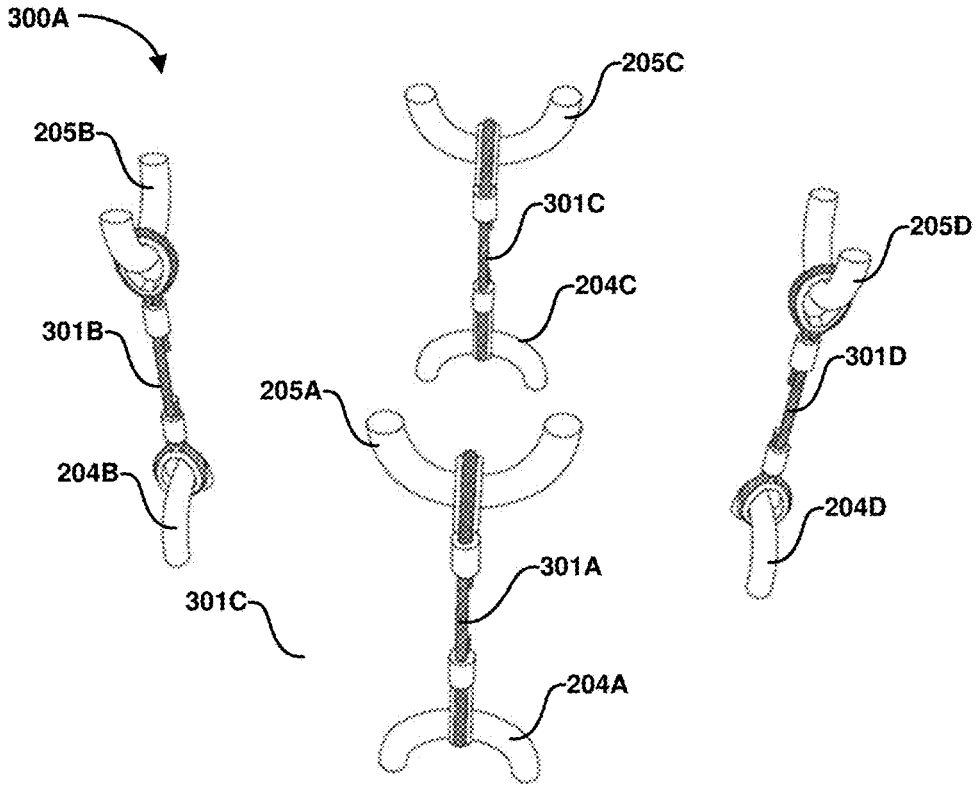
FIGS. 3A-D are views of the vertical superelasticity-assisted slider system (SSS-v) implementations, for implementing embodiments of the present disclosure.
Figure 3B:
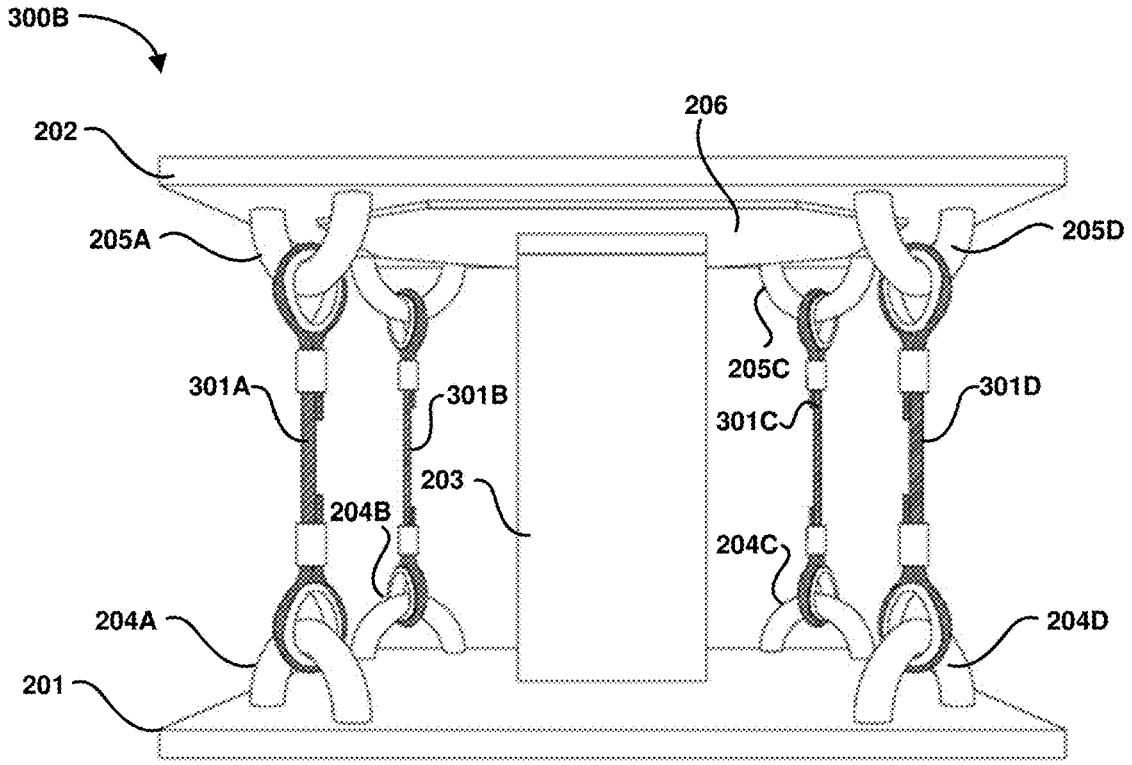
Figure 3C:
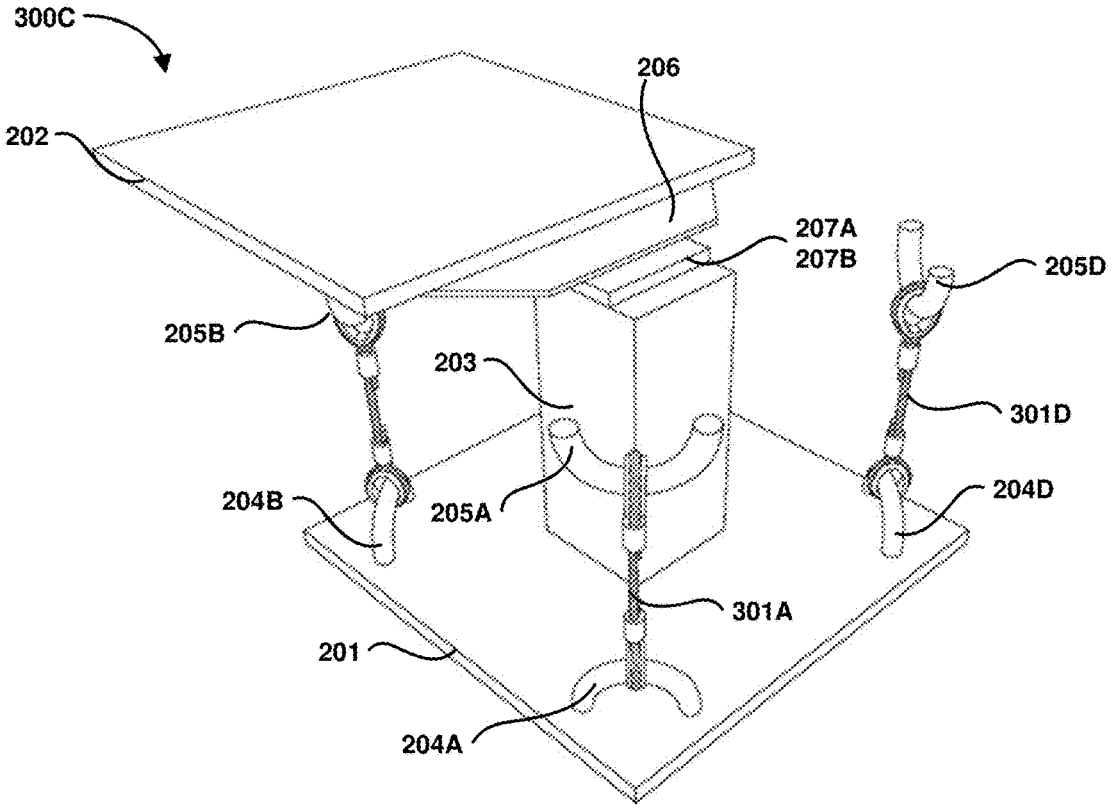
Figure 3D:
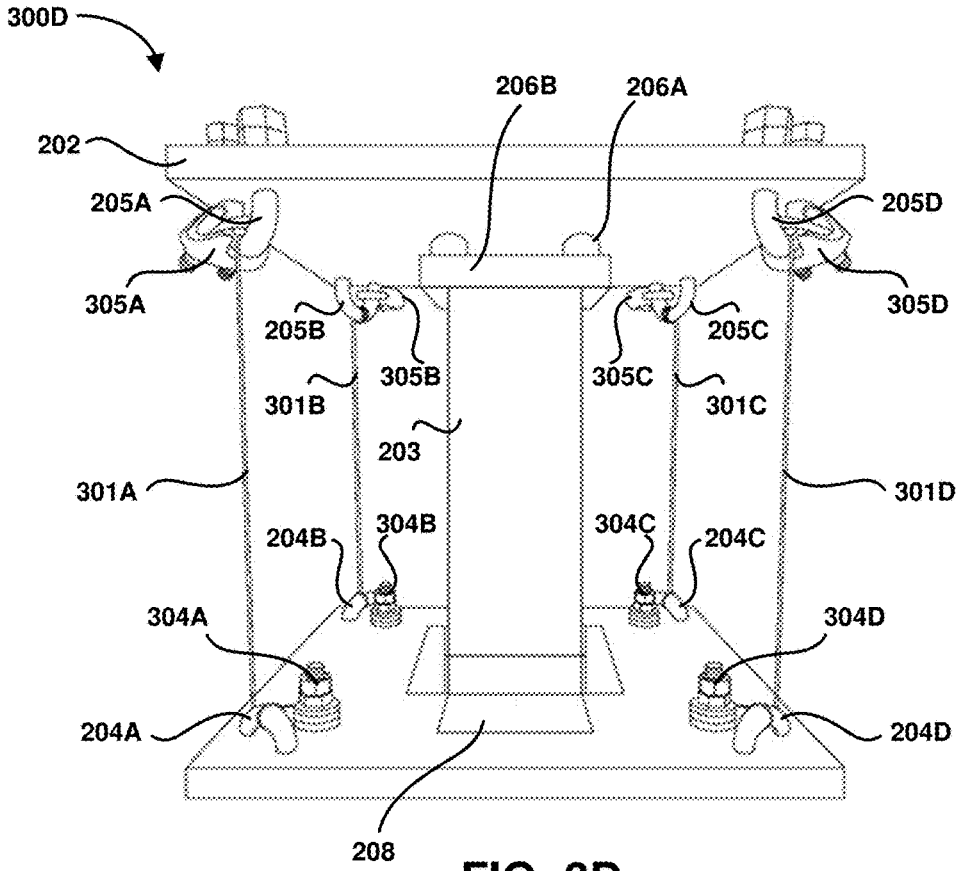
Figure 3E:
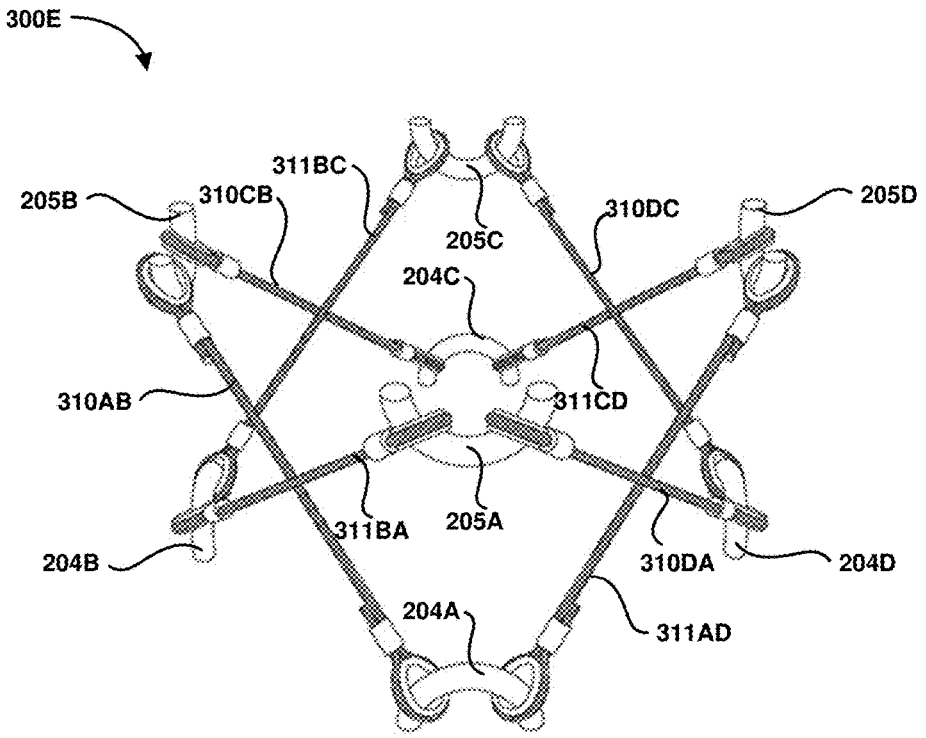
FIGS. 3E-F are views of the diagonal superelasticity-assisted slider system (SSS-d) implementations, for implementing embodiments of the present disclosure.
Figure 3F:
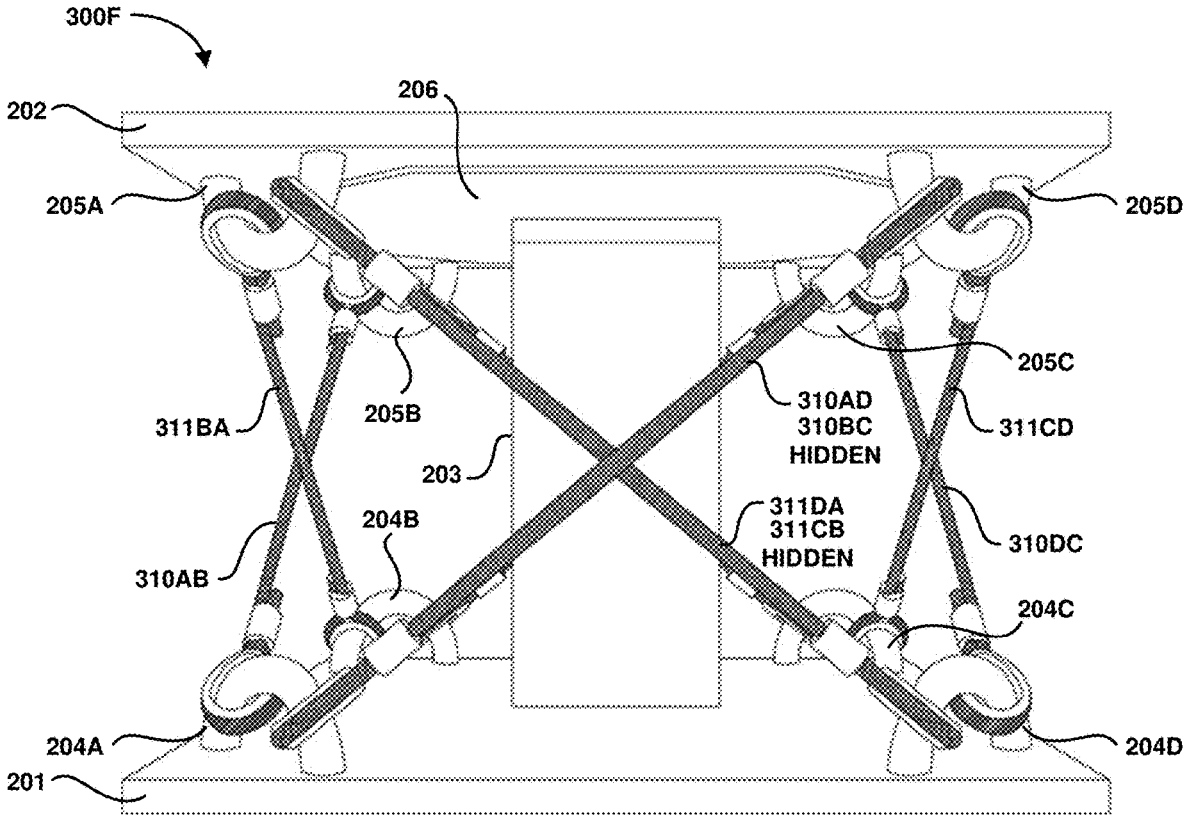

FIGS. 3E-F are views of the diagonal superelasticity-assisted slider system (SSS-d) implementations 300E-F, for implementing embodiments of the present disclosure. The SSS-d implementation 300E is for installation in a traditional construction building. Bottom hinging rings 204A-D are secured to the foundation of the building and top hinging rings 205A-D are secured to the structure of the building. SMA cables 310AB, 311BA, 310BC, 311CB, 310DC, 311CD, 310AD and 311DA extend diagonally in one or more vertical planes as shown and between and secured to the respective bottom hinging rings 204A-D and top hinging rings 205A-D, as shown. It should be understood that while eight diagonal SMA cables 310AB, 311BA, 310BC, 311CB, 310DC, 311CD, 310AD and 311DA are shown, fewer than eight SMA cables could be used.

The SSS-d implementation 300F is for installation in an isolation unit that can be installed between the foundation and structure of the building, as shown in FIG. 1A. In SSS-d implementation 300B, the bottom hinging rings 204A-D are secured to the bottom plate 201 and the top hinging rings 205A-D are secured to the top plate 202. SMA cables 310AB, 311BA, 310BC, 311CB, 310DC, 311CD, 310AD and 311DA extend diagonally in one or more vertical planes as shown and between and secured to the respective bottom hinging rings 204A-D and top hinging rings 205A-D, as shown. It should be understood that while eight diagonal SMA cables 310AB, 311BA, 310BC, 311CB, 310DC, 311CD, 310AD and 311DA are shown, fewer than eight SMA cables could be used.

Figure 3G:
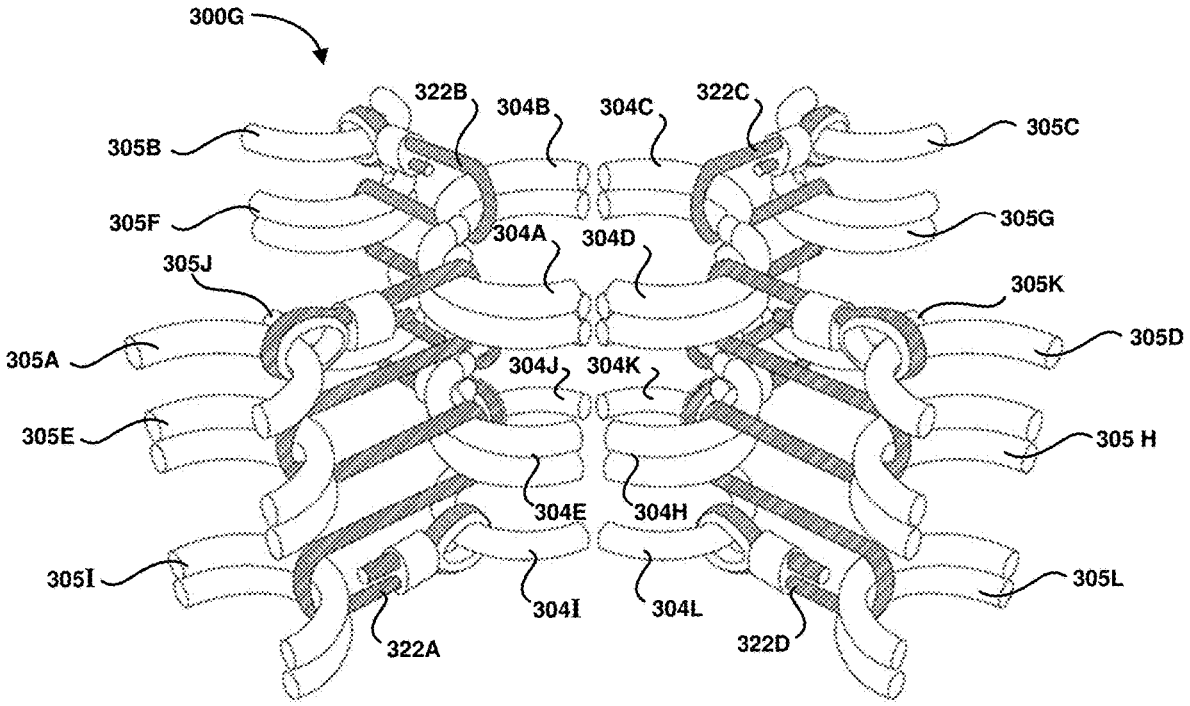
FIGS. 3G-H are views of the horizontal superelasticity-assisted slider system (SSS-h) implementations, for implementing embodiments of the present disclosure.
Figure 3H:
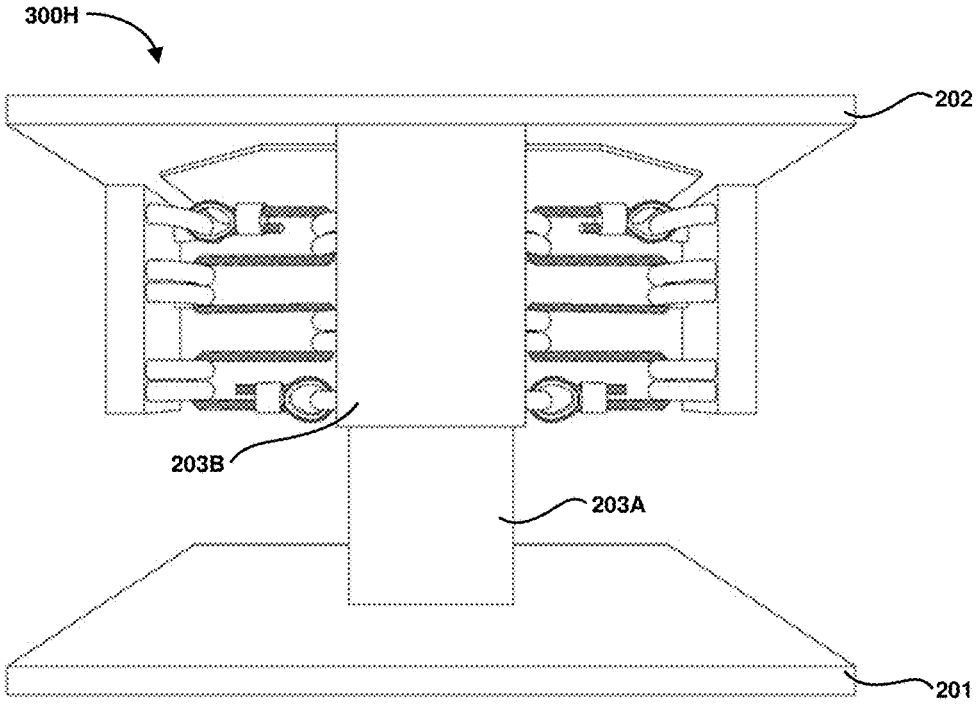

FIGS. 3G-H are views of the horizontally implemented superelasticity-assisted slider system (SSS-h) implementations 300G and 300H, for implementing embodiments of the present disclosure. The SSS-h implementation 300G is for installation in a traditional construction building. Hinging rings 304A-L are secured to the pier 203A that is connected to the foundation of the building. Hinging rings 305A-L are secured to the structure of the building through elements 203B and 202. The SSS-h implementation 300H is for installation in an isolation unit that can be installed between a building foundation and the building structure. Horizontally implemented SMA cables 322A-D extend through and between multiple horizontal planes, as shown, and through the hinging rings and secured to the end hinging rings. By way of example, horizontally implemented cable 322A is secured to hinging ring 305A and extends through hinging ring 304A, through hinging ring 305E, through hinging ring 304E, through hinging ring 305I, to be secured to hinging ring 304I to form an H-shape, as shown. Similarly, horizontally implemented cable 322B is secured to hinging ring 305B and extends through hinging ring 304B, through hinging ring 305F, through hinging ring 304F, through hinging ring 305J, to be secured to hinging ring 304J. Similarly, horizontally implemented cable 322C is secured to hinging ring 305C and extends through hinging ring 304C, through hinging ring 305G, through hinging ring 304G, through hinging ring 305K, to be secured to hinging ring 304K. Similarly, horizontally implemented cable 322D is secured to hinging ring 305D and extends through hinging ring 304D, through hinging ring 305H, through hinging ring 304H, through hinging ring 305L, to be secured to hinging ring 304L.

Figure 3I:
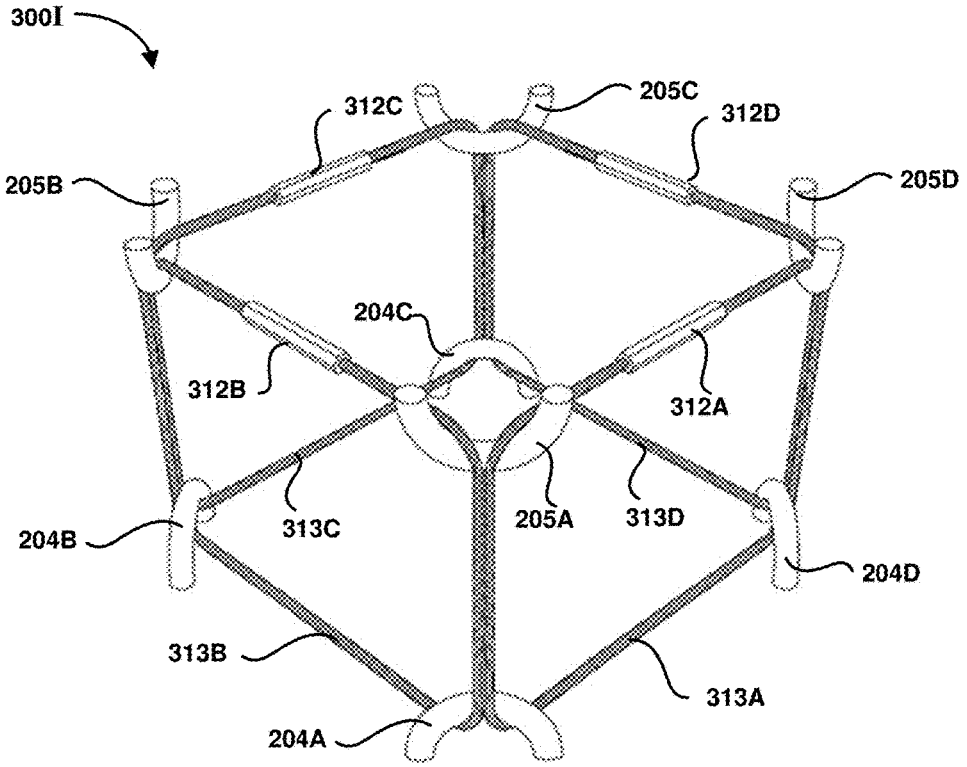
FIGS. 3I-J are views of the O-shaped superelasticity-assisted slider system (SSS-o) implementations, for implementing embodiments of the present disclosure.
Figure 3J:
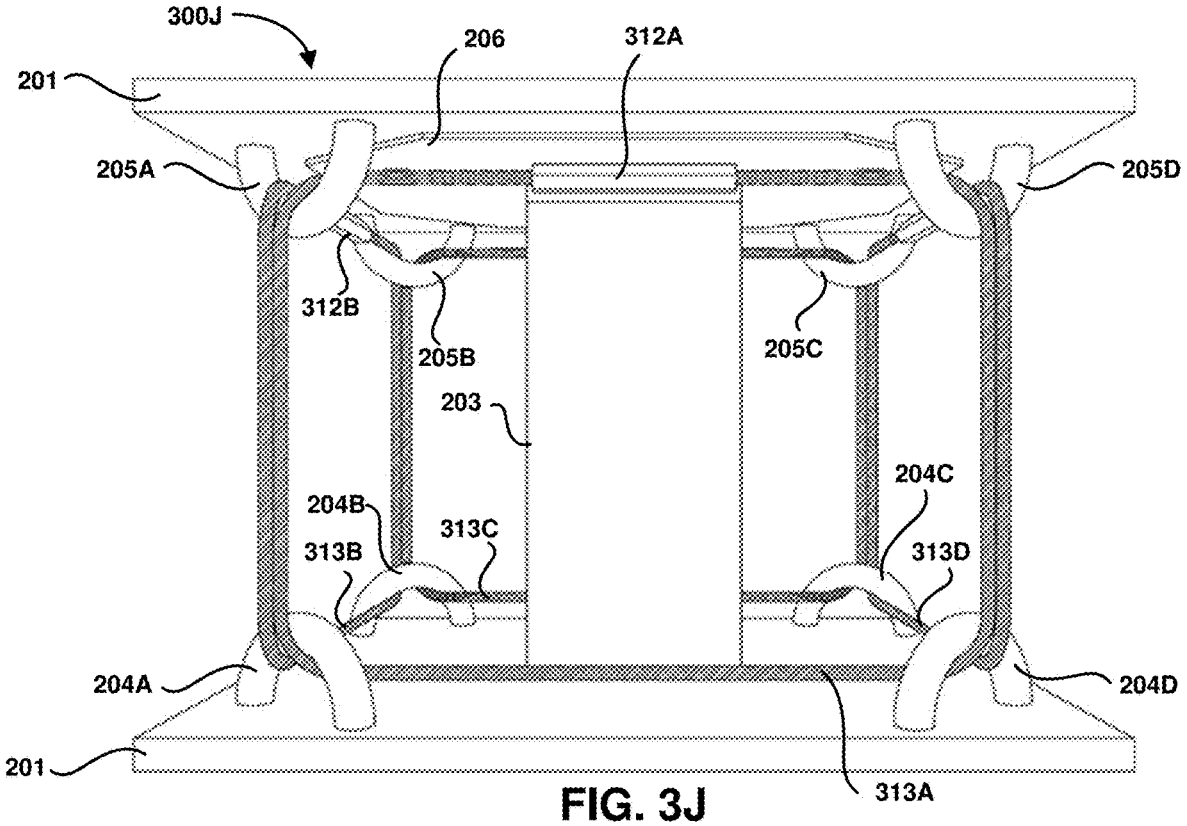

FIGS. 3I-J are views of the O-shaped superelasticity-assisted slider system (SSS-o) implementations 300I-J, for implementing embodiments of the present disclosure. The SSS-o implementation 300I is for installation in a traditional construction building. Bottom hinging rings 204A-D are secured to the foundation of the building and top hinging rings 205A-D are secured to the structure of the building. O-shaped SMA cables 313A, 313B, 313C and 313D extend through four hinging rings along multiple edges of a single vertical plane, as shown. By way of example, O-shaped cable 313A extends sequentially through hinging rings 205A, to 204A, to 204D to 205D, through end clamp 312A to form a closed loop or O-shape, as shown. Similarly, O-shaped SMA cable 313B extends sequentially through hinging rings 205B, to 204B, to 204A to 205A, through end clamp 312B to form a closed loop. Similarly, O-shaped SMA cable 313C extends sequentially through hinging rings 205C, to 204C, to 204B to 205B, through end clamp 312C to form a closed loop. Similarly, O-shaped SMA cable 313D extends sequentially through hinging rings 205D, to 204D, to 204C to 205C, through end clamp 312D to form a closed loop. It should be understood that while four O-shaped SMA cables 313A, 313B, 313C and 313D are shown, fewer than four O-shaped SMA cables could be used.

The SSS-o implementation 300J is for installation in an isolation unit that can be installed between the foundation and structure of the building, as shown in FIG. 1A. In SSS-o implementation 300F, the bottom hinging rings 204A-D are secured to the bottom plate 201 and the top hinging rings 205A-D are secured to the top plate 202. SMA cables 313A, 313B, 313C and 313D sequentially through the respective bottom hinging rings 204A-D and top hinging rings 205A-D, as shown. It should be understood that while four O-shaped SMA cables 313A, 313B, 313C and 313D are shown, fewer than four O-shaped SMA cables could be used.

Figure 3K:
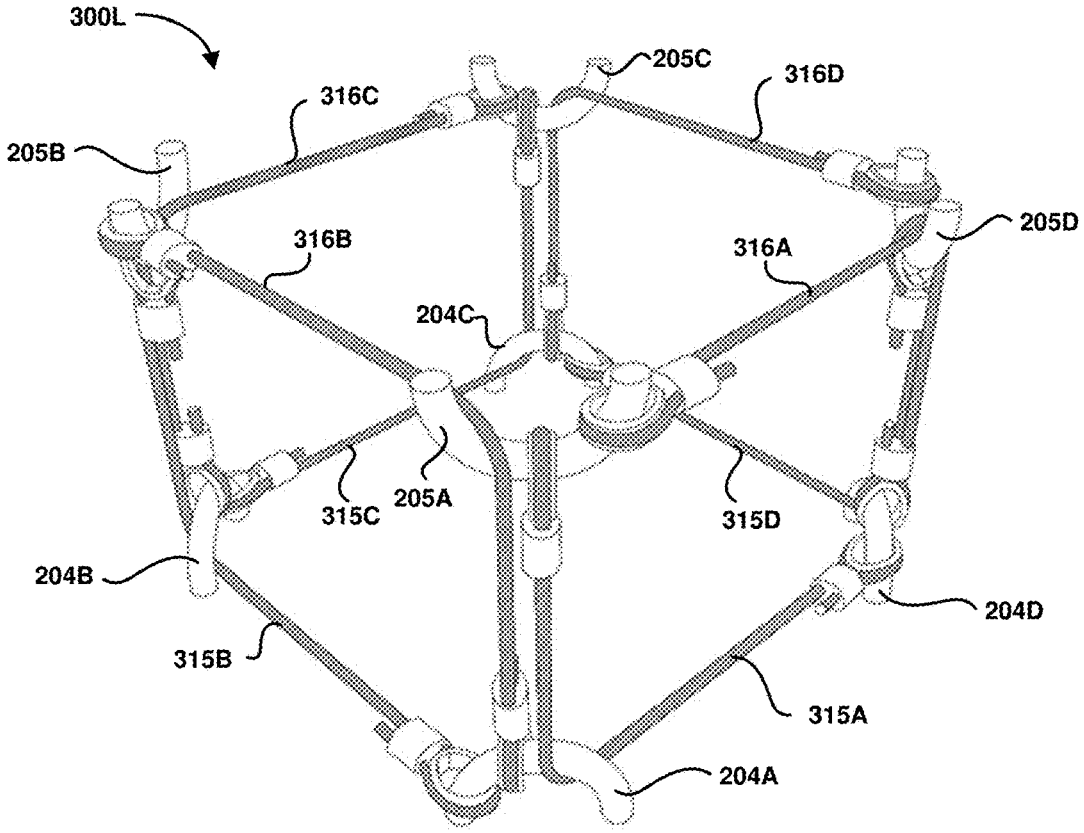
FIG. 3K is a view of the L-shaped superelasticity-assisted slider system (SSS-1) implementations, for implementing embodiments of the present disclosure.

FIG. 3K is a view of the L-shaped superelasticity-assisted slider system (SSS-l) implementations 300K, for implementing embodiments of the present disclosure. The SSS-l implementation 300K is for installation in a traditional construction building. Bottom hinging rings 204A-D are secured to the foundation of the building and top hinging rings 205A-D are secured to the structure of the building, however, the SSS-l implementation 300K can similarly be implemented in an isolation unit. L-shaped SMA cables 315A, 315B, 315C, 315D, 316A, 316B, 316C and 316D extend along multiple edges of a single vertical plane, as shown and through the hinging rings. By way of example, L-shaped cable 315A is secured to hinging ring 205A and extends through hinging ring 204A to be secured to hinging ring 204D to form an L-shape, as shown. Similarly, L-shaped SMA cable 315B is secured to hinging ring 205B and extends through hinging ring 204B to be secured to hinging ring 204A. Similarly, L-shaped SMA cable 315C is secured to hinging ring 205C and extends through hinging ring 204C, to be secured to hinging ring 204B. Similarly, L-shaped SMA cable 315D is secured to hinging ring 205D and extends through hinging ring 204D, to be secured to hinging ring 204C. Similarly, L-shaped SMA cable 316A is secured to hinging ring 205A and extends through hinging ring 205D to be secured to hinging ring 204D. Similarly, L-shaped SMA cable 316B is secured to hinging ring 205B and extends through hinging ring 205A to be secured to hinging ring 204A. Similarly, L-shaped SMA cable 316C is secured to hinging ring 205C and extends through hinging ring 205B, to be secured to hinging ring 204B. Similarly, L-shaped SMA cable 316D is secured to hinging ring 205D and extends through hinging ring 205C, to be secured to hinging ring 204C. It should be understood that while eight L-shaped SMA cables 315A, 315B, 315C, 315D, 316A, 316B, 316C and 316D are shown, fewer than eight L-shaped SMA cables could be used.

Figure 3L:
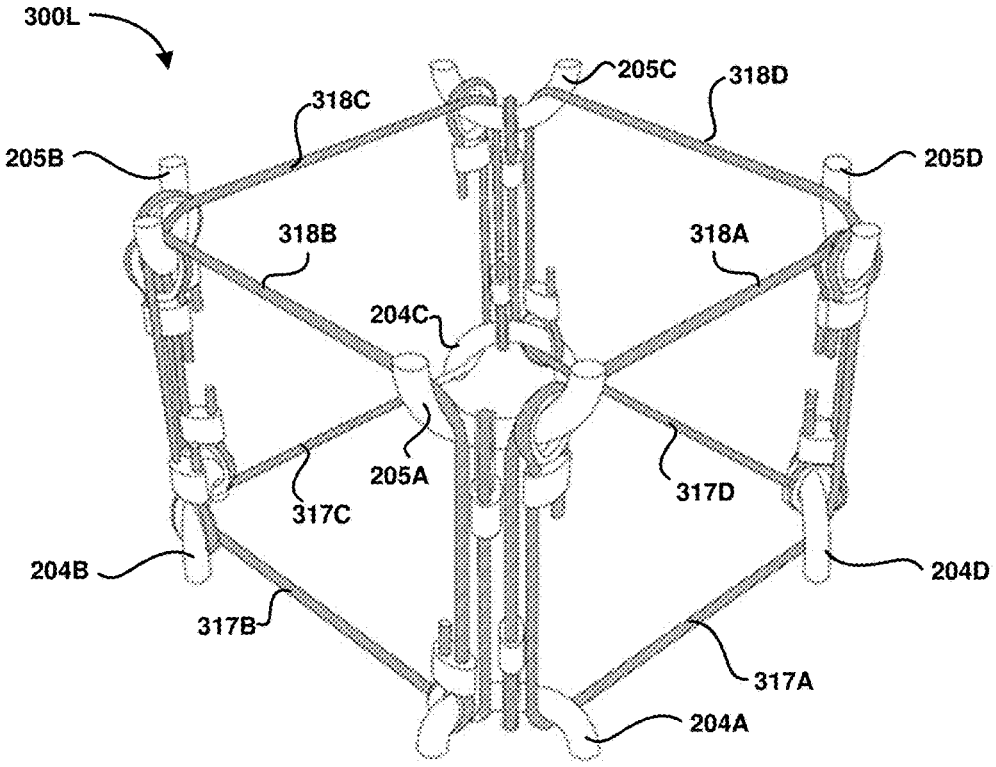
FIG. 3L is a view of the U-shaped superelasticity-assisted slider system (SSS-u) implementations, for implementing embodiments of the present disclosure.

FIG. 3L is a view of the U-shaped superelasticity-assisted slider system (SSS-u) implementations 300J, for implementing embodiments of the present disclosure. The SSS-u implementation 300L is for installation in a traditional construction building. Bottom hinging rings 204A-D are secured to the foundation of the building and top hinging rings 205A-D are secured to the structure of the building, however, the SSS-U implementation 300J can similarly be implemented in an isolation unit. U-shaped SMA cables 317A, 317B, 317C, 317D, 318A, 318B, 318C and 318D extend along multiple edges of a single vertical plane, as shown and through the hinging rings. By way of example, U-shaped cable 317A is secured to hinging ring 205A and extends through hinging ring 204A through hinging ring 204D to be secured to hinging ring 205D to form a U-shape, as shown. Similarly, U-shaped SMA cable 317B is secured to hinging ring 205B and extends through hinging ring 204B and through hinging ring 204A be secured to hinging ring 205A. Similarly, U-shaped SMA cable 317C is secured to hinging ring 205C and extends through hinging ring 204C and through hinging ring 204B, to be secured to hinging ring 205B. Similarly, U-shaped SMA cable 317D is secured to hinging ring 205D and extends through hinging ring 204D, through hinging ring 204C to be secured to hinging ring 205C. Similarly, U-shaped SMA cable 318A is secured to hinging ring 204A and extends through hinging ring 205A through hinging ring 205D to be secured to hinging ring 204D. Similarly, U-shaped SMA cable 318B is secured to hinging ring 204B and extends through hinging ring 205B through hinging ring 205A to be secured to hinging ring 204A. Similarly, U-shaped SMA cable 318C is secured to hinging ring 204C and extends through hinging ring 205C, through hinging ring 204B to be secured to hinging ring 205B. Similarly, U-shaped SMA cable 318D is secured to hinging ring 204D and extends through hinging ring 205D, through hinging ring 205C to be secured to hinging ring 204C. It should be understood that while eight U-shaped SMA cables 317A, 317B, 317C, 317D, 318A, 318B, 318C and 318D are shown, fewer than eight U-shaped SMA cables could be used.

Figure 3M:
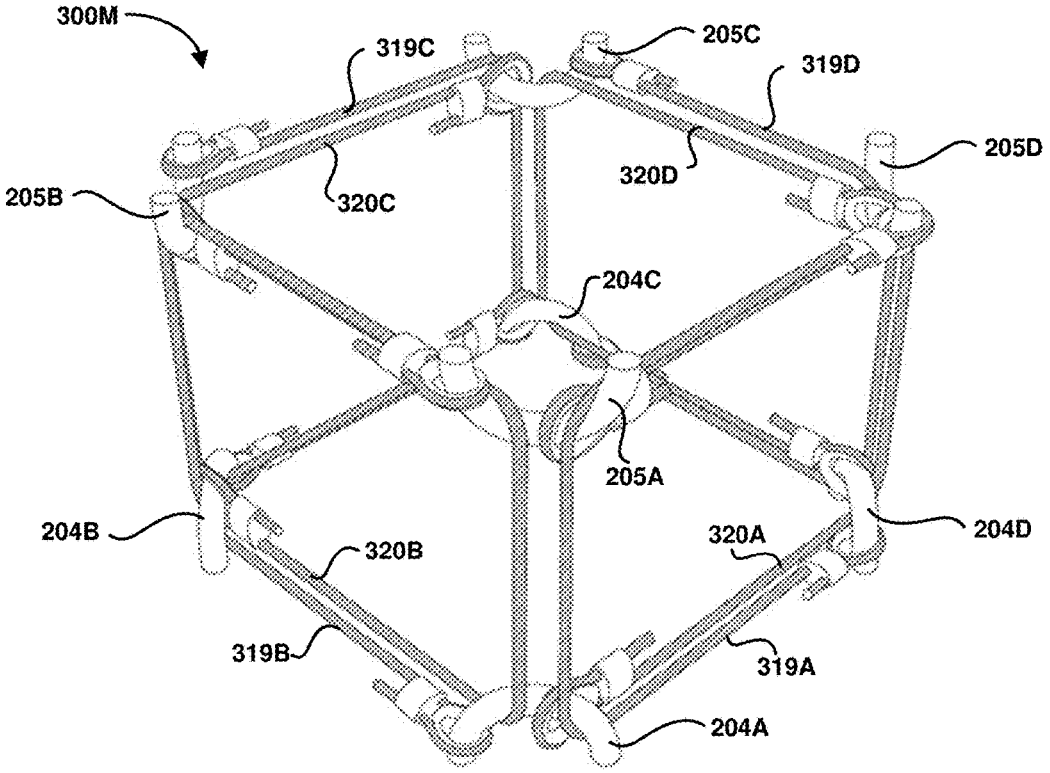
FIGS. 3M-N are views of the C-shaped superelasticity-assisted slider system (SSS-c) implementations, for implementing embodiments of the present disclosure.
Figure 3N:
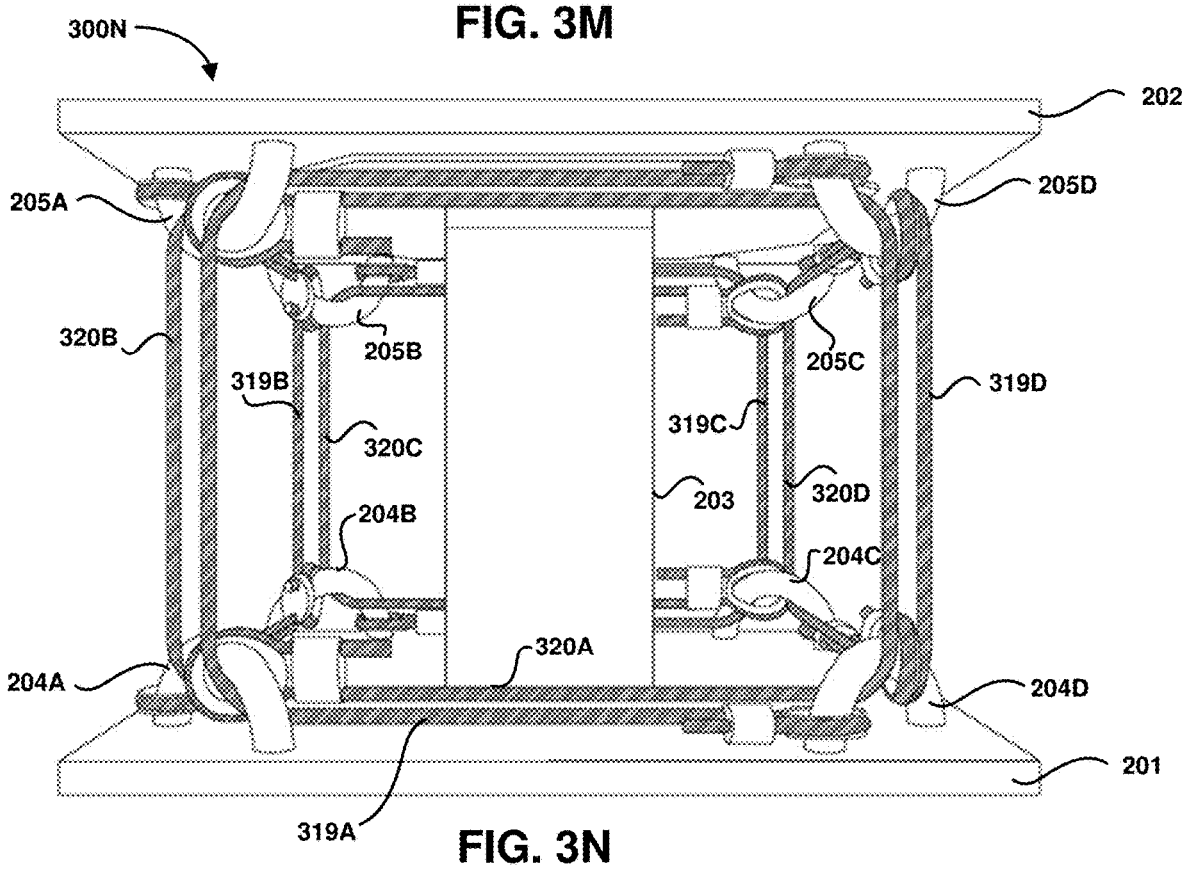
Figure 4A:
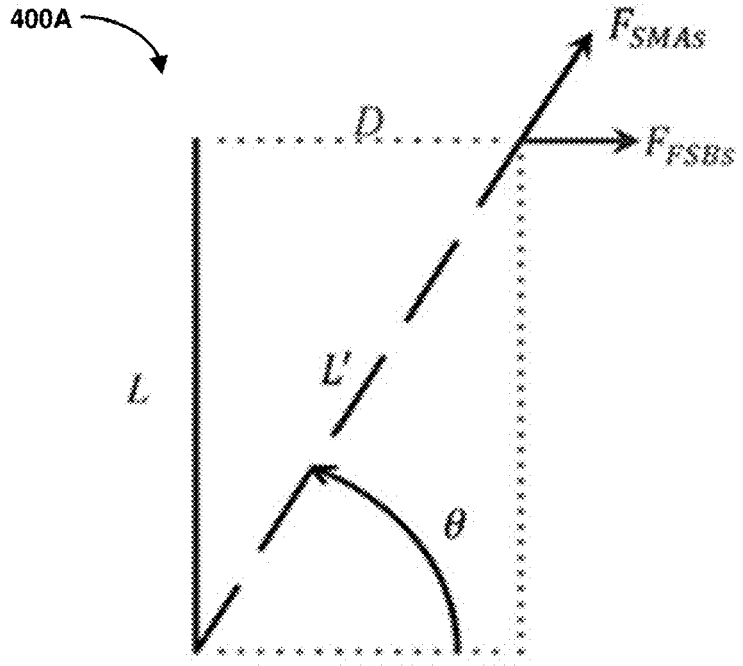
Figure 4B:
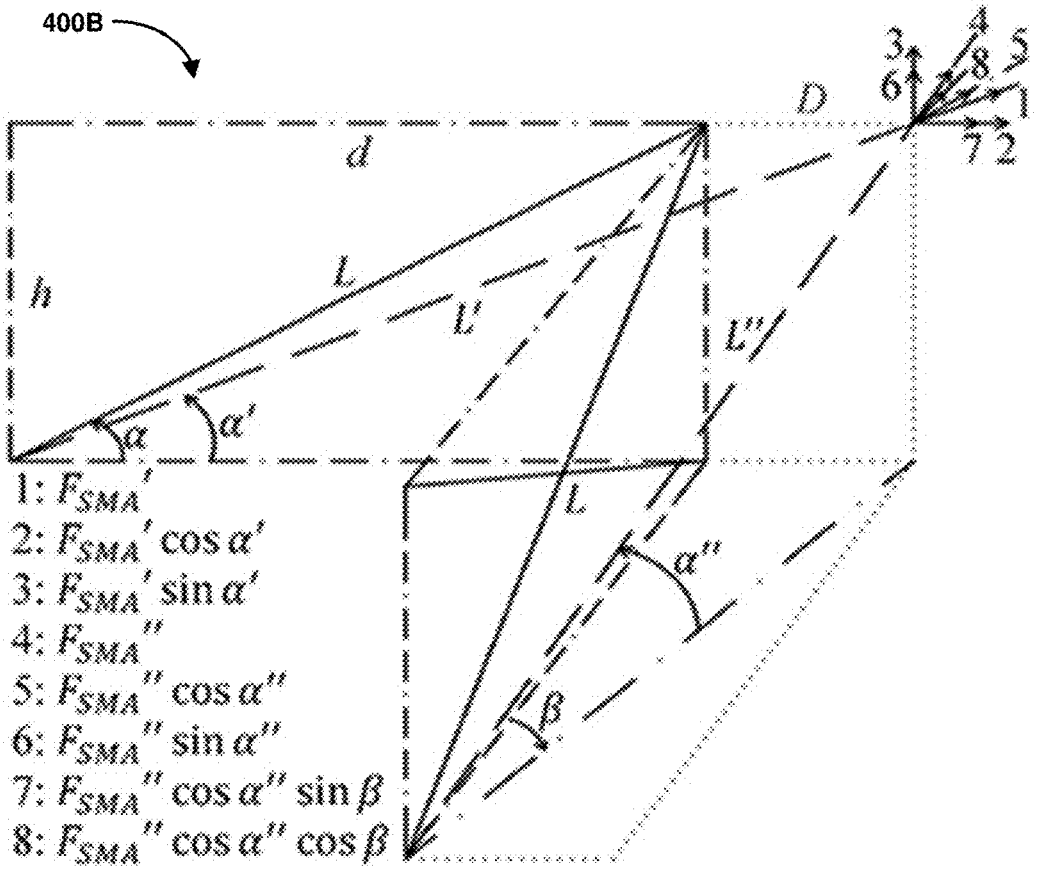
Figure 4C:
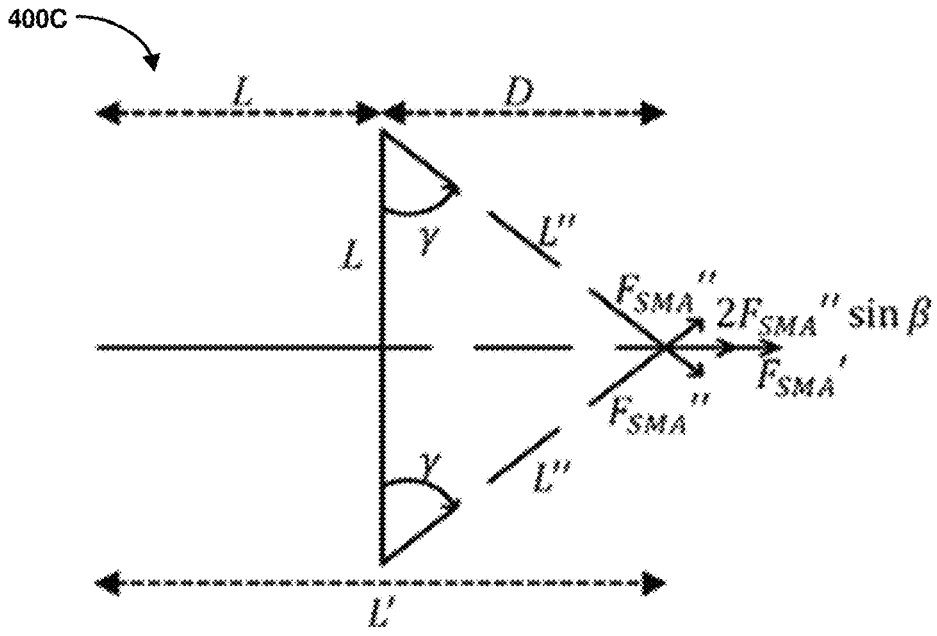
Figure 4D:
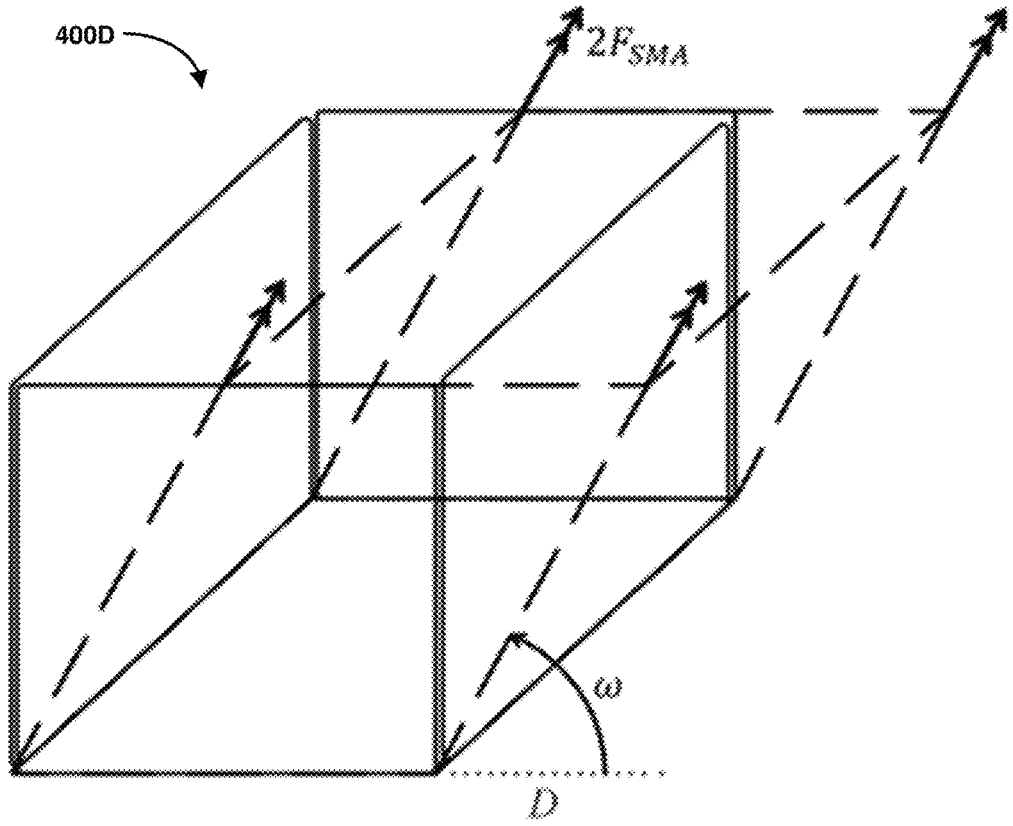
Figure 4E:
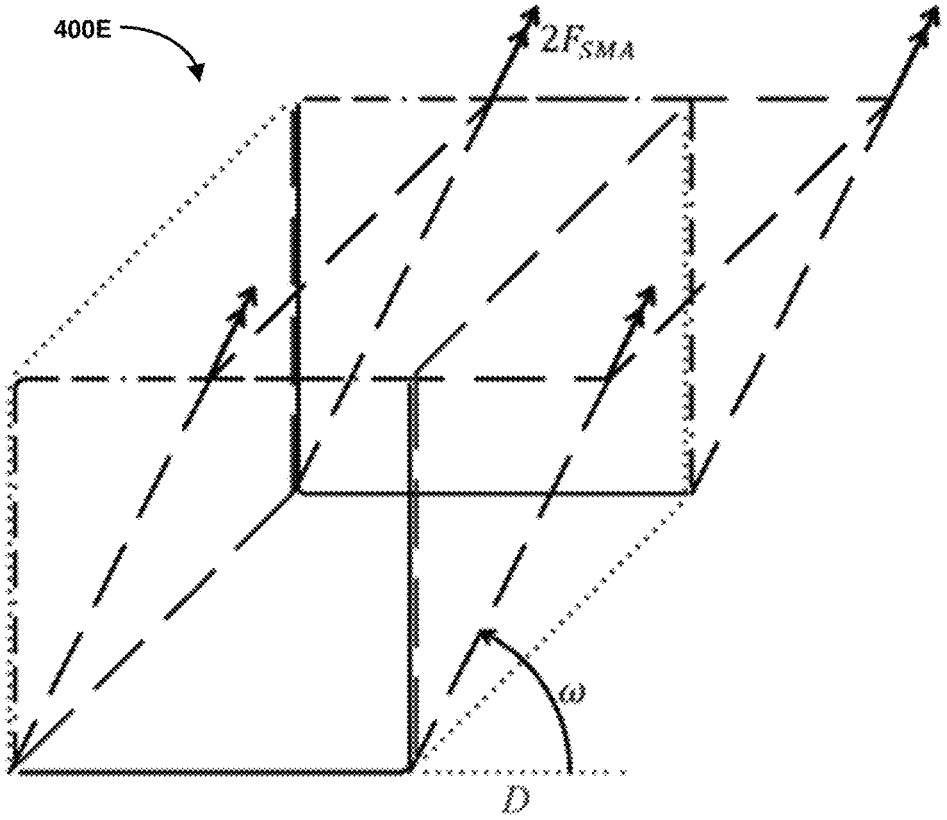
Figure 4F:
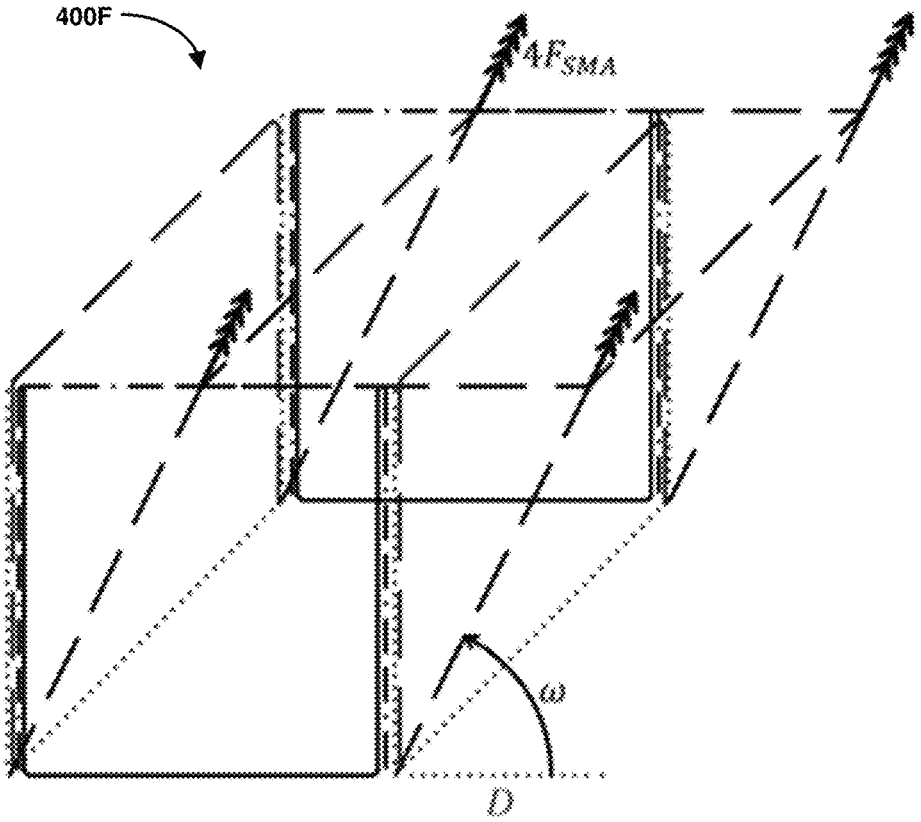
Figure 5A:
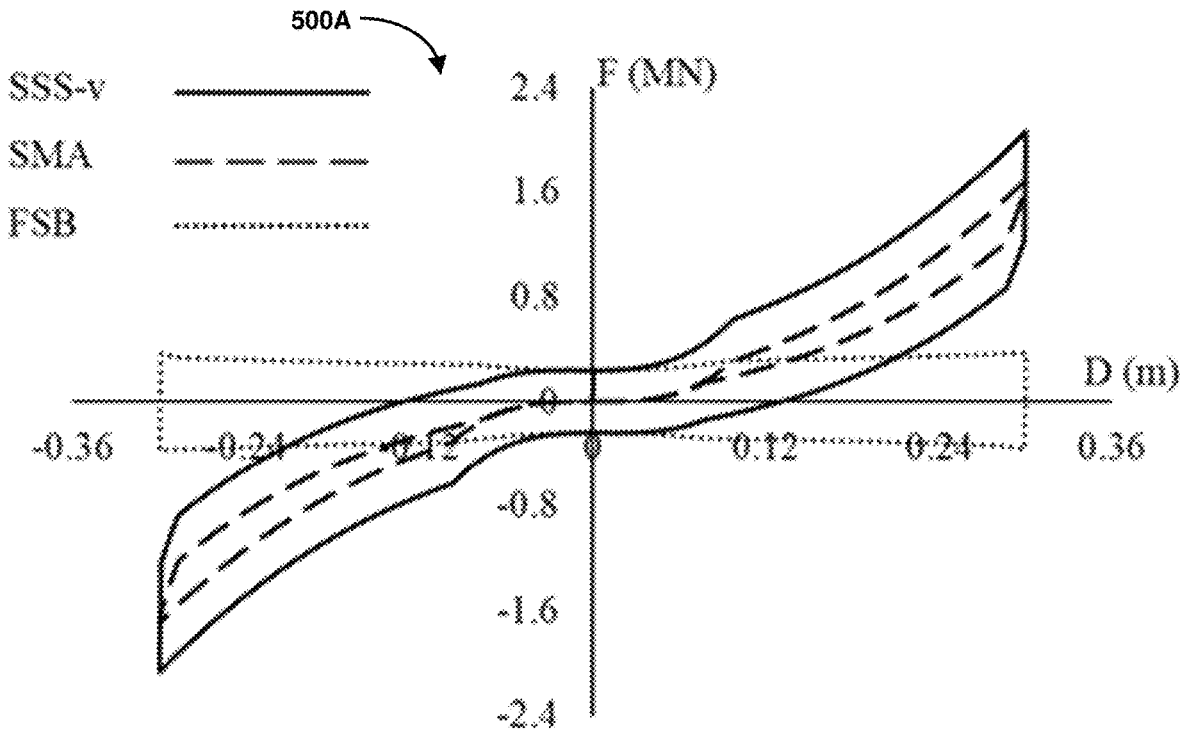
FIGS. 5A-G are graphs of a numerically obtained force-displacement (F-D) behavior for all of the SSS implementations, for implementing embodiments of the present disclosure.
Figure 5B:
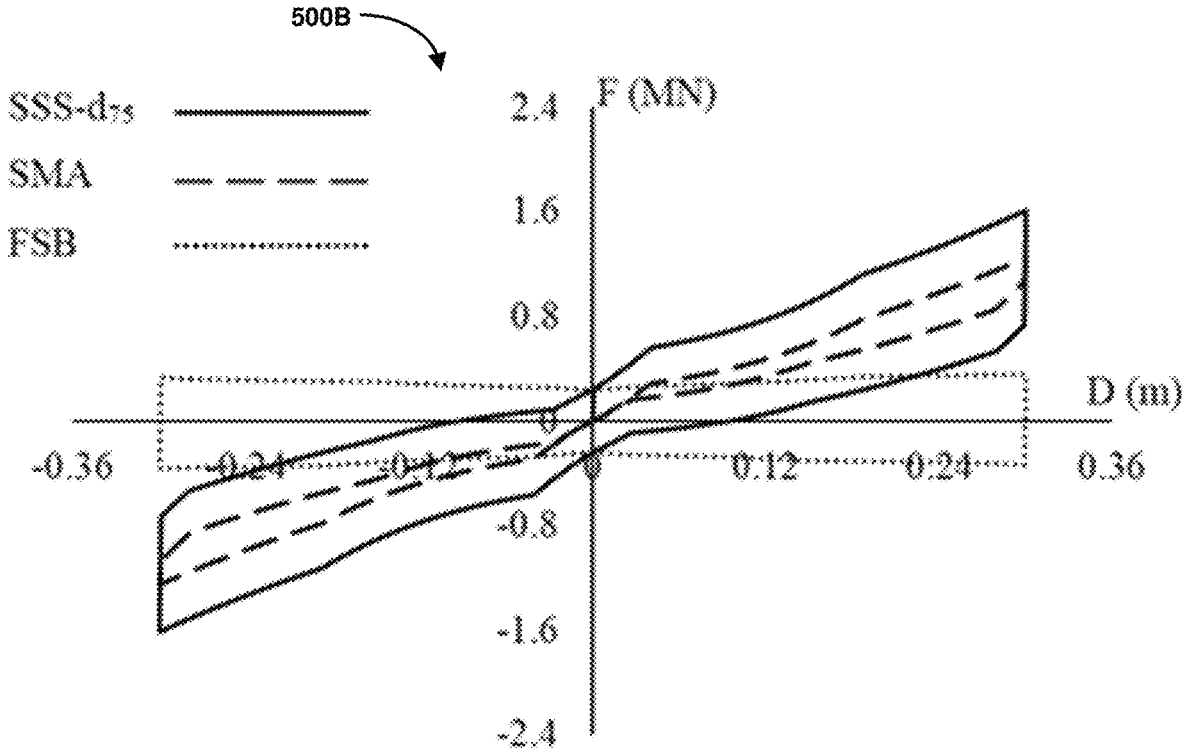
Figure 5C:
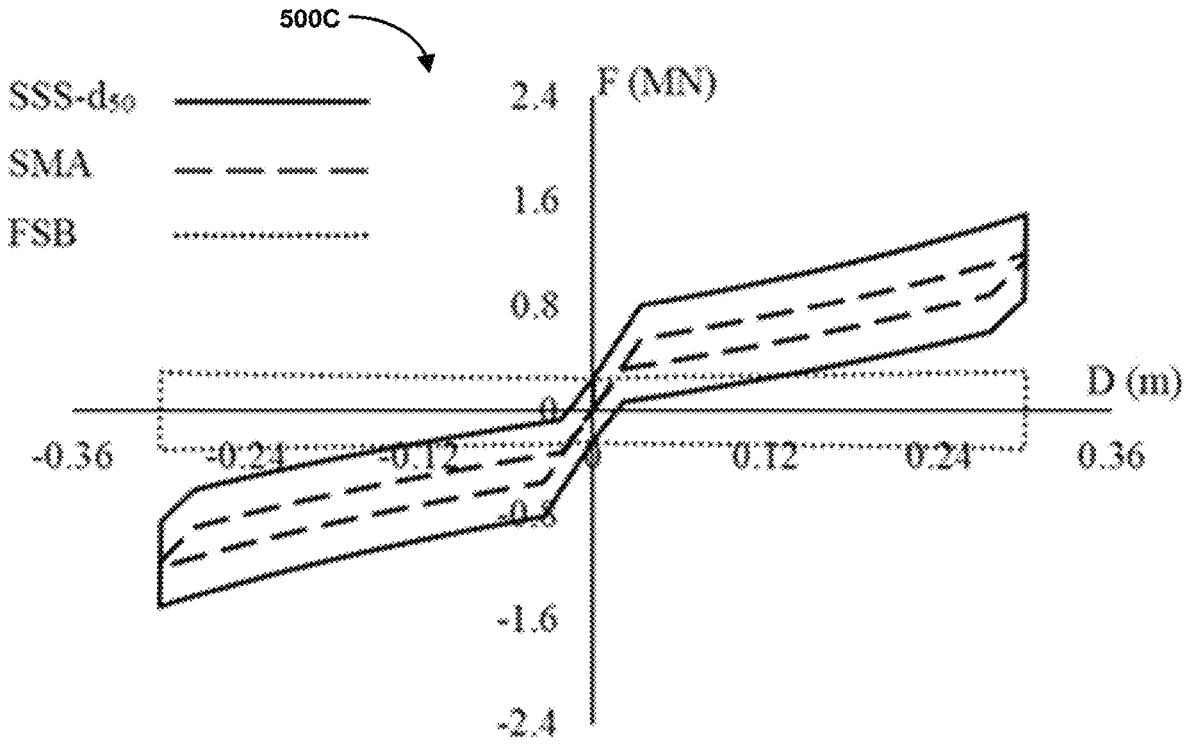
Figure 5D:
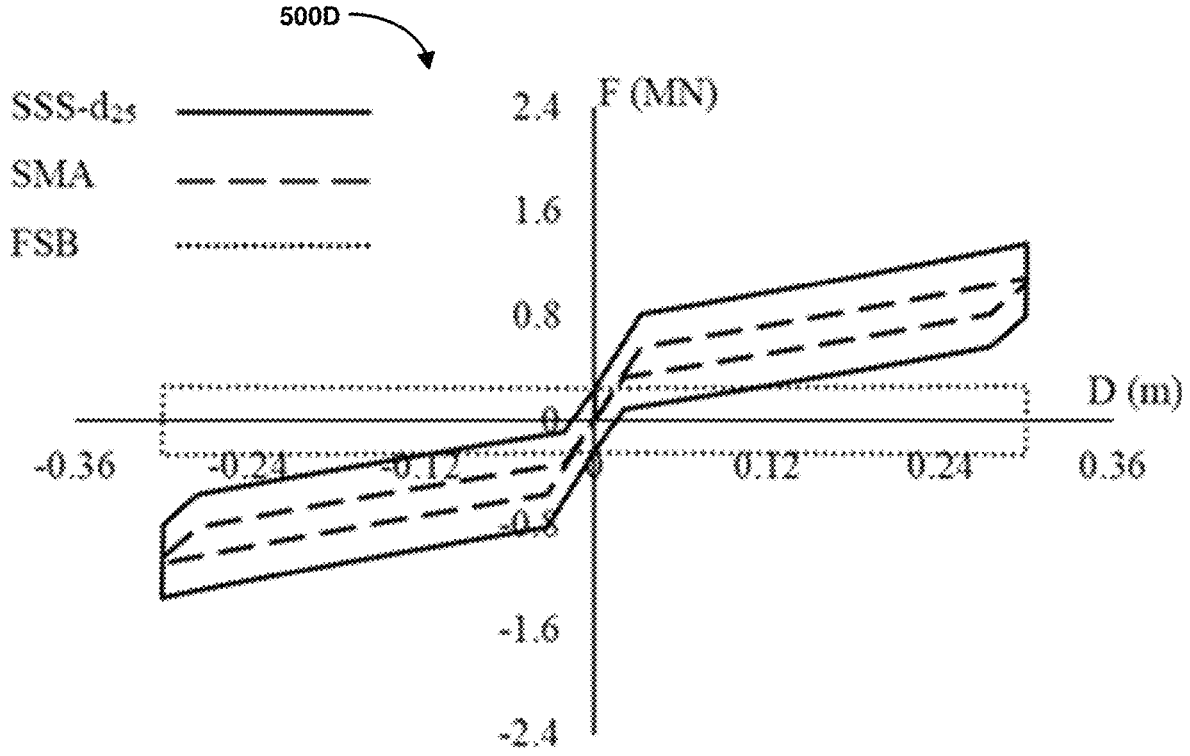
Figure 5E:
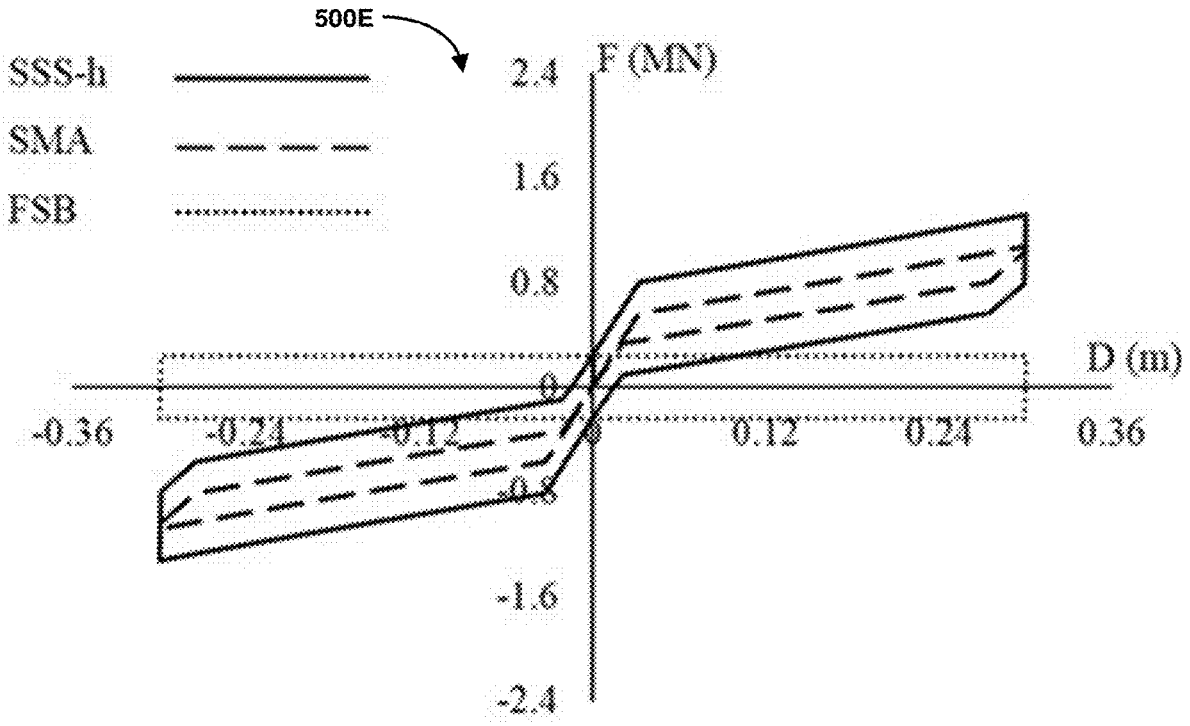
Figure 5F:
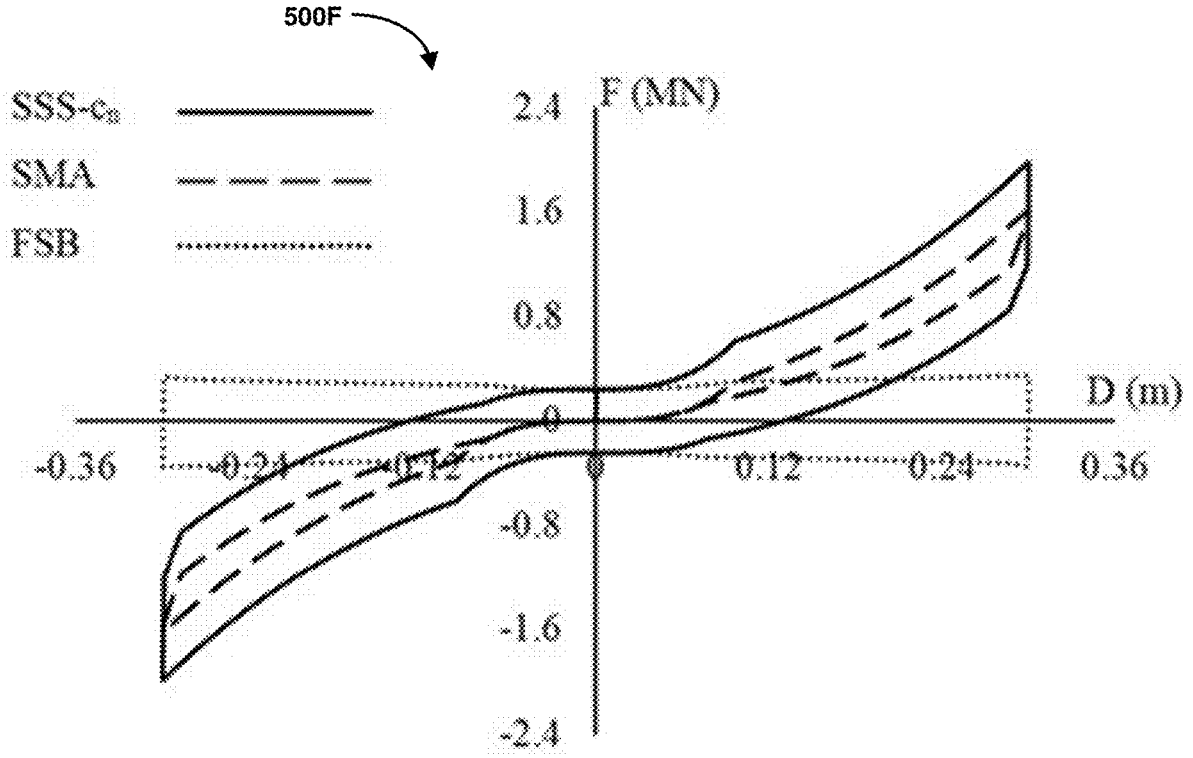
Figure 5G:
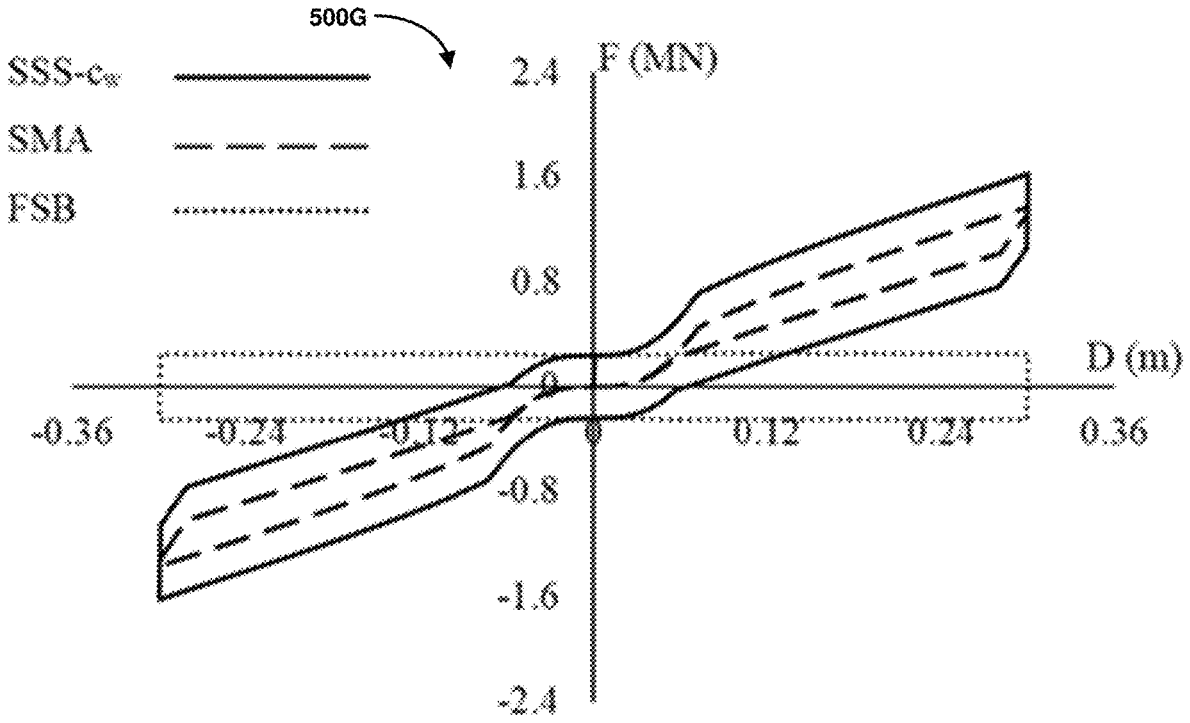
Figure 6A:
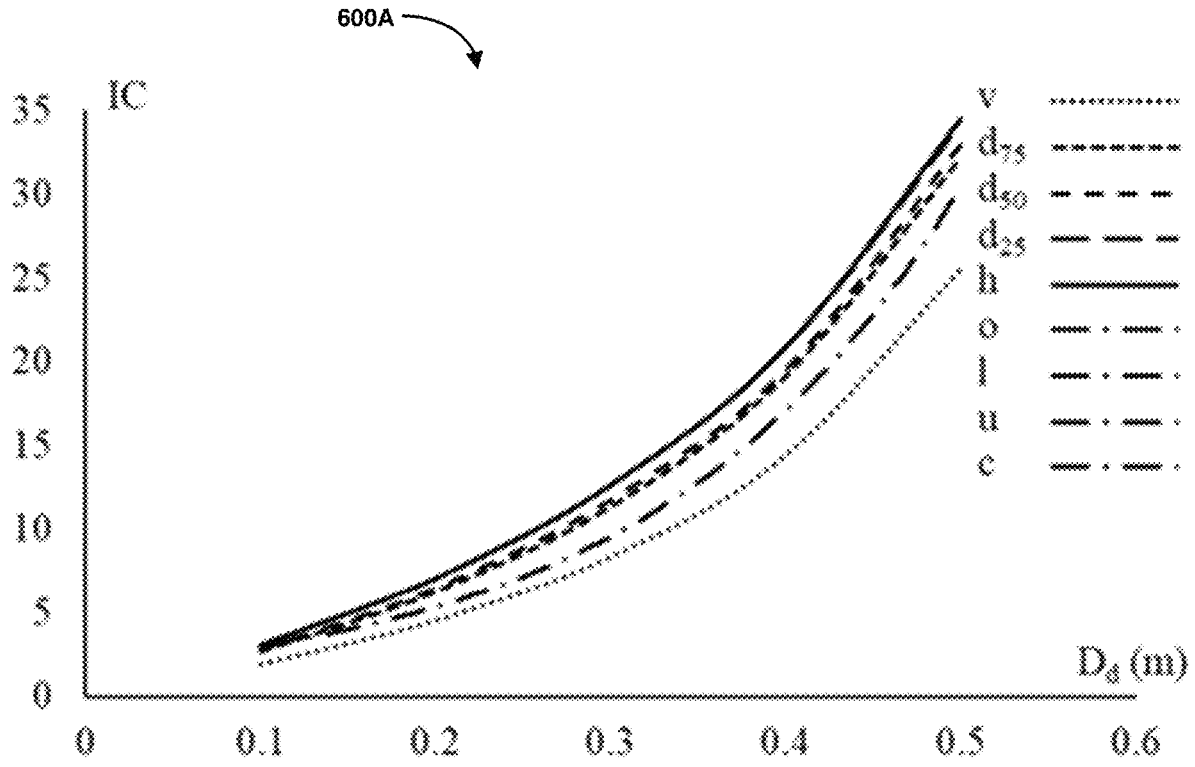
FIGS. 6A-D are graphs comparing isolation capabilities, self-centering capabilities and practicalities for all of the SSS implementations, for implementing embodiments of the present disclosure.
Figure 6B:
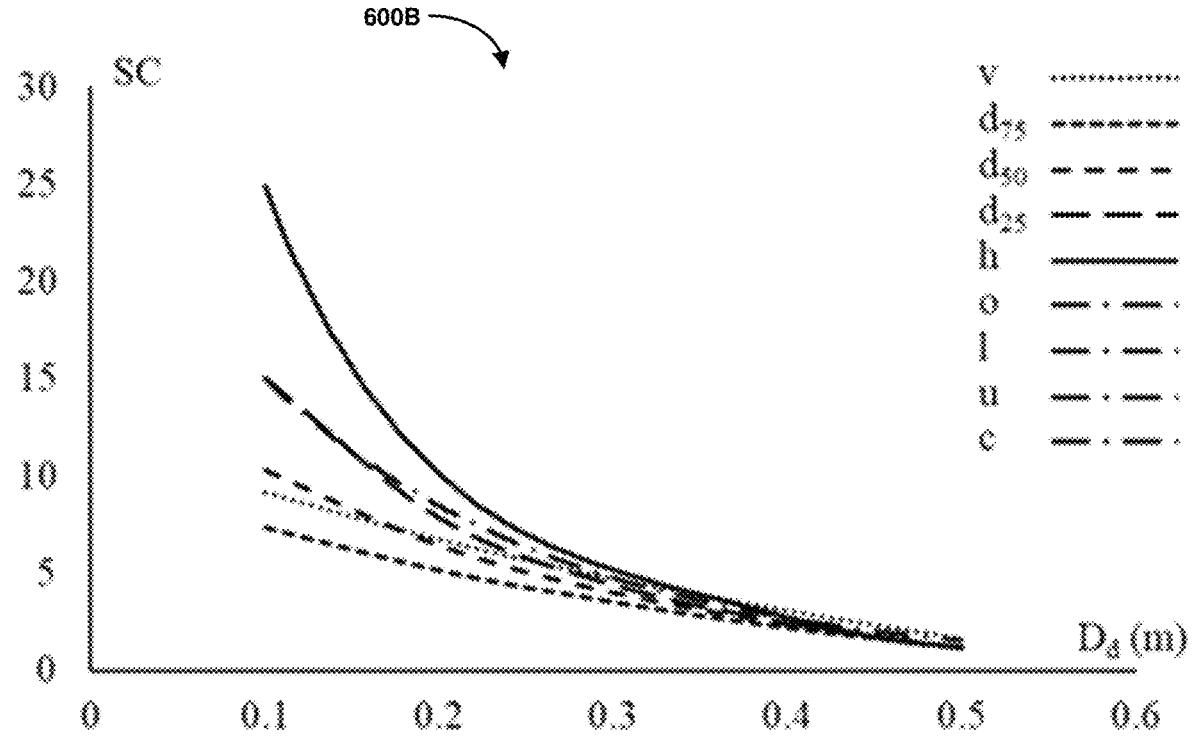
Figure 6C:
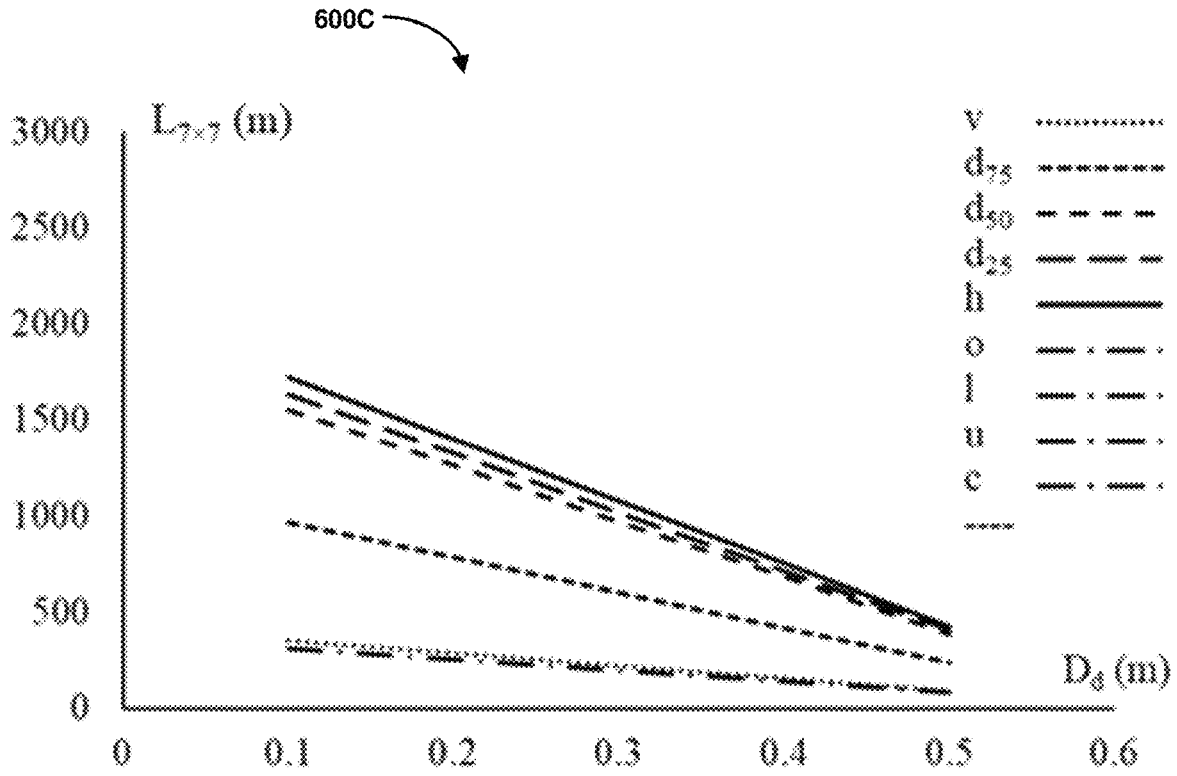
Figure 6D:
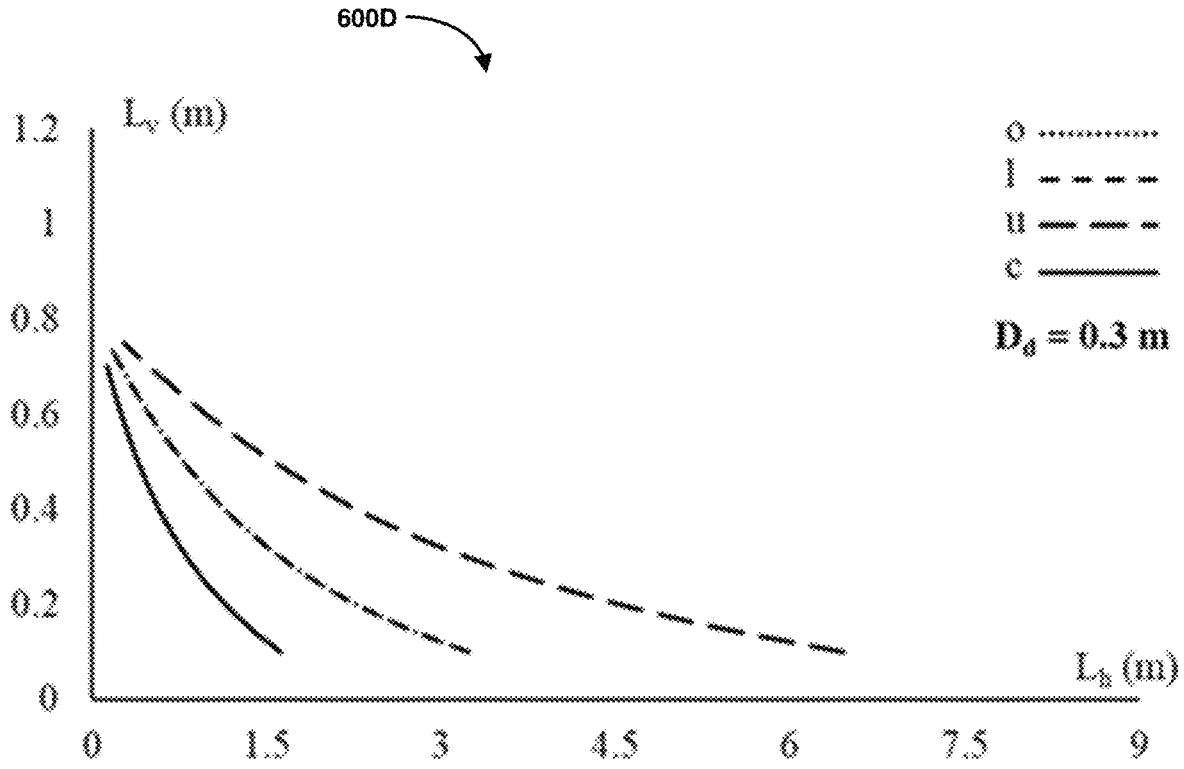

FIGS. 3M-N are views of the C-shaped superelasticity-assisted slider system (SSS-c) implementations 300M and 300L, for implementing embodiments of the present disclosure. The SSS-c implementation 300M is for installation in a traditional construction building. Bottom hinging rings 204A-D are secured to the foundation of the building and top hinging rings 205A-D are secured to the structure of the building. C-shaped SMA cables 319A, 319B, 319C, 319D, 320A, 320B, 320C and 320D extend along multiple edges of a single vertical plane, as shown and through the hinging rings. By way of example, C-shaped cable 319A includes a first end secured to hinging ring 204D and extends through hinging ring 205A, through hinging ring 204A, with a second end secured to hinging ring 205D to form a C-shape, as shown. Similarly, C-shaped SMA cable 319B includes a first end secured to hinging ring 204A and extends through hinging ring 204B and through hinging ring 205B with a second end secured to hinging ring 205A. Similarly, C-shaped SMA cable 319C includes a first end secured to hinging ring 204B and extends through hinging ring 204C and through hinging ring 205C, with a second end secured to hinging ring 205B. Similarly, C-shaped SMA cable 319D includes a first end secured to hinging ring 204C and extends through hinging ring 205D, through hinging ring 204D with a second end secured to hinging ring 205C. Similarly, C-shaped SMA cable 320A includes a first end secured to hinging ring 204A and extends through hinging ring 205D through hinging ring 204D with a second end secured to hinging ring 205A. Similarly, C-shaped SMA cable 320B includes a first end secured to hinging ring 204B and extends through hinging ring 204A through hinging ring 205A with a second end secured to hinging ring 205B. Similarly, C-shaped SMA cable 320C includes a first end secured to hinging ring 204C and extends through hinging ring 205B, through hinging ring 204B with a second end secured to hinging ring 205C. Similarly, C-shaped SMA cable 320D includes a first end secured to hinging ring 204D and extends through hinging ring 205C, through hinging ring 204C with a second end secured to hinging ring 205D. It should be understood that while eight C-shaped SMA cables 319A, 319B, 319C, 319D, 320A, 320B, 320C and 320D are shown, fewer than eight C-shaped SMA cables could be used. The SSS-c implementation 300L is for installation in an isolation unit that can be installed between a building foundation and the building structure.

FIGS. 4A-H are graphs of a working principle of the superelasticity-assisted slider system, for implementing embodiments of the present disclosure. The working principle of SSS illustrates the schematic rigid body diagrams in each alternative implementation and also providing exemplary design formulas for the SSS-v implementation. The design procedure is developed as a code-based design using Eurocode (EC8, 2004) and at least one implementation. Although it should be understood that other code base systems could similarly be used. The "C" FIG. 4H indicates that they can install application without the use of off-site fabricated isolation units (IUs) is considered and the "I" represents the industrialized modern application for the use of IUs, $n_c$ is the number of cables in the system, $n_w$ is the number of wires in the layout considered for the cables (e.g., 49 in the 7×7 layout), the $\Phi$ is the diameter of each wire in the cable, $\sigma_{sma}$ is the instantaneous value of axial stress available in the SMA material, $n_t$ is the number of IUs, $\mu$ is the coefficient of friction, and W is the weight of the isolated structure with the alternative expression as the sum of the weights available on IUs or FSBs ($W_j$).

FIGS. 5A-G are graphs of a numerically obtained force-displacement (F-D) behavior for all of the SSS implementations, for implementing embodiments of the present disclosure. Three different angles are considered for the diagonal arrangement of SMA cables and two narrow and wide extreme cases of SSS-c, referred to respectively as SSS-$c_n$ and SSS-$c_w$ represent SSS-u, SSS-l and SSS-o. The geometric nonlinearity as the highest effect and SSS-v decreasing when the inclination angles are increased in the different cases of SSS-d. There is minimal to no geometric nonlinearity in SSS-h. The effect of geometric nonlinearity and SSS-c, SSS-u, SSS-l and SSS-o is between the geometric nonlinearity of SSS-v and SSS-h. SSS-$c_n$, as the narrow case of SSS-c, as the highest nonlinearity within other forms of this implementation when the lowest nonlinearity occurs in the SSS-$c_w$. These different behaviors result in various performances that provide SSS with an effective versatility in practice.

FIGS. 6A-D are graphs comparing isolation capabilities and self-centering capabilities for all of the SSS implementations, for implementing embodiments of the present disclosure. The isolation capabilities and self-centering capabilities of the alternative configurations of SSS with their respective different design cases are compared at a practical range of design displacement ($D_d$). FIGS. 6A-D also includes a comparison of the lengths of SMA cables assuming an example of a 7×7 layout utilized in the different implementations of SSS, together with a more detailed comparison regarding the lengths of the horizontal and vertical arms of the O, L, U and C-shaped cables in the respective implementations in the SSS-o, SSS-L, SSS-u and SSS-c implementations designed for $D_d$=0.3 m. The figures illustrate proposed system capable to protect different structures against earthquakes providing the structures with different effective performances at corresponding different costs associated with utilization of the SMA cables in which the SSS-c is the most practical configuration due to its small dimensions (e.g., shorter $L_h$) in addition to a minimum length of the SMA cables to obtain acceptable IC and SC.

Figure 7:
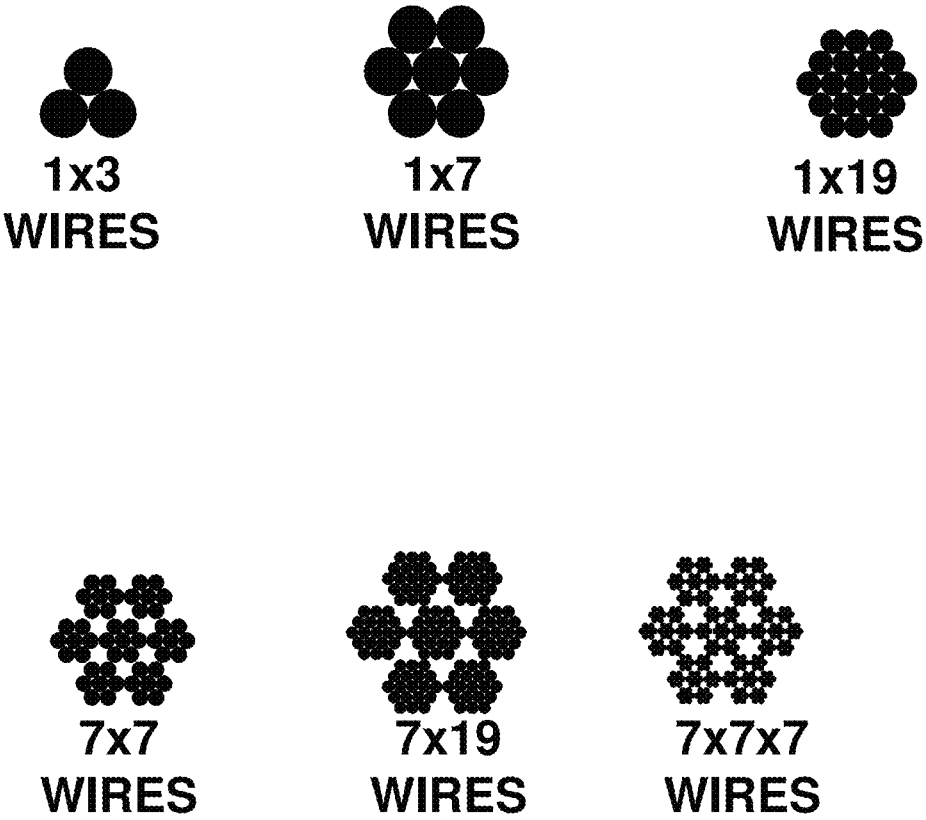
FIG. 7 is a cross-sectional drawing of several exemplary cable structures that may be utilized for the shape memory alloy cable implementations, for implementing embodiments of the present disclosure.

Some of the design options for an example building with 20 columns, a design displacement of, for example 30 centimeters, a typical lubricated SUS-PTFE sliding surface for the FSB component of the system, and a 7×7 cross-section layout for the SMA component are summarized as follows. FIG. 7 is a cross-sectional drawing of several exemplary cable structures that may be utilized for the shape memory alloy cable implementations, for implementing embodiments of the present disclosure. A) SSS-v, with 0.82-meter-long 7×7 cables made up of 1.75-millimeter-diameter wires to be used within the IUs of this configuration to be installed under each column of the building in the IU-based industrialized style of implementation or as simply connected to the foundation and the base slab of the building around its columns or in any equivalent form in the sub-structure level in the IU-less traditional style. B) SSS-$d_{75}$, with 1.58-meter-long 7×7 cables made up of 1.54-millimeter-diameter wires to be used within the IUs of this configuration to be installed under each column of the building in the industrialized style of implementation or as simply connected to the foundation and the base slab of the building in any equivalent form in the traditional style. C) SSS-h, with 4.61-meter-long 7×7 cables made up of 1.63-millimeter-diameter wires to be used within the IUs of this configuration to be installed under each column of the building in the industrialized style of implementation or as simply connected to the foundation and the base slab of the building in any equivalent form in the traditional style. D) SSS-$c_n$, with 0.95-meter-long ($L_v$=0.7 m and $L_h$=0.125 m) 7×7 cables made up of 1.13-millimeter-diameter wires to be used within the IUs of this configuration to be installed under each column of the building in the industrialized style of implementation or as simply connected to the foundation and the base slab of the building in any equivalent form in the traditional style. E) SSS-$c_w$, with 3.34-meter-long ($L_v$=0.1 m and $L_h$=1.62 m) 7×7 cables made up of 0.67-millimeter-diameter wires to be used within the IUs of this configuration to be installed under each column of the building in the industrialized style of implementation or as simply connected to the foundation and the base slab of the building in any equivalent form in the traditional style. Of course, the design is not limited to the above-mentioned cases and in addition to the other options provided by the other configurations of the system since the system benefits from a multi-parameter design many other possibilities are also available. Below are some examples that can be compared to the cases above. F) SSS-v, with the SMA cables at the same length of the case (A) but a layout of 7×49 made up of 0.66-millimeter-diameter wires. G) SSS-$d_{45}$, with 3.36-meter-long 7×7 cables made up of 1.36-millimeter-diameter wires. H) SSS-c, with 2.25-meter-long ($L_v$=0.25 m and $L_h$=1 m) 7×7 cables made up of 0.75-millimeter-diameter wires.

In another implementation of protecting equipment, where the total weight of the equipment is assumed to be 10 tons with the possibility of installing any number of IUs, which for example purposed is 4 and all the other assumptions are same as those in the previous examples A-E, unless the cross-section layout of the SMA component which is assumed as 1×3 for this small-scale application. Below are some of the design options. I) SSS-v, with 0.82-meter-long 1×3 cables made up of 2.2-millimeter-diameter wires. J) SSS-$d_{75}$, with 1.58-meter-long 1×3 cables made up of 1.88-millimeter-diameter wires. K) SSS-h, with 4.61-meter-long 1×3 cables made up of 2-millimeter-diameter wires. L) SSS-$c_n$, with 0.95-meter-long ($L_v$=0.7 m and $L_h$=0.125 m) 1×3 cables made up of 1.38-millimeter-diameter wires. M) SSS-$c_w$, with 3.34-meter-long ($L_v$=0.1 m and $L_h$=1.62 m) 1×3 cables made up of 0.95-millimeter-diameter wires. Again, the design is not limited to the above-mentioned cases and in addition to the other options provided by the other configurations of the system since the system benefits from a multi-parameter design many other possibilities are also available. Below are some examples that can be compared to the cases above. N) SSS-v, with the SMA cables at the same length of the case (I) but a layout of 1×7 made up of 1.46-millimeter-diameter wires. O) SSS-$d_{45}$, with 3.36-meter-long 1×3 cables made up of 1.73-millimeter-diameter wires. P) SSS-c, with 2.25-meter-long ($L_v$=0.25 m and $L_h$=1 m) 1×3 cables made up of 1.02-millimeter-diameter wires.

Although the foregoing disclosure has been described in some detail for purposes of clarity of understanding, it will be apparent that certain changes and modifications may be practiced within the scope of the appended claims. It should be understood that when building and building structures are referred to herein, the disclosure is not limited to buildings such as office building and the like but should be considered in broader terms of manmade structures including in a non-limiting examples of bridges, towers, reactors, monuments, artworks, and other manmade structures and even including equipment. Accordingly, the present embodiments are to be considered as illustrative and not restrictive, and the disclosure is not to be limited to the details given herein, but may be modified within the scope and equivalents of the appended claims.

What is claimed is:

1. A super-elastic slider system comprising at least one shape metal alloy element between a first plate of the super-elastic slider system and a second plate of the super-elastic slider system, the at least one shape metal alloy element having an initial shape, wherein the first plate of the super-elastic slider system is configured to be attached to a building foundation and the second plate of the super-elastic slider system is configured to be attached to a building structure, wherein a pier configured to support the building structure extends between the first plate and the second plate of the super-elastic slider system and wherein the at least one shape metal alloy element extends exterior of the pier and includes:

a first terminating end, wherein the first terminating end is secured to a first hinging ring; and a second terminating end, opposite from the first terminating end, wherein the second terminating end is secured to a second hinging ring, the first hinging ring is secured to the first plate of the super-elastic slider system and the second hinging ring is secured to the second plate of the super-elastic slider system.

2. The system of claim 1, wherein the at least one shape metal alloy element includes multiple shape metal alloy elements.

3. The system of claim 2, wherein the multiple shape metal alloy elements are arrayed in two parallel planes.

4. The system of claim 2, wherein the multiple shape metal alloy elements are arrayed in at least one first plane and at least one second plane perpendicular to and intersecting with the at least one first plane.

5. The system of claim 1, wherein the at least one shape metal alloy element extends through two or more intersecting perpendicular planes.

6. The system of claim 1, wherein the at least one shape metal alloy element extends through and between two or more parallel planes.

7. The system of claim 1, wherein the at least one shape metal alloy element extends along an intersection of two intersecting perpendicular planes.

8. A super-elastic slider system comprising:

a first plate of the super-elastic slider system including a first plurality of hinging rings, the first plate of the super-elastic slider system configured to be attached to a building foundation;

a second plate of the super-elastic slider system including a second plurality of hinging rings, the second plate of the super-elastic slider system configured to be attached to a building structure;

a pier configured to support the building structure and extending between the first plate of the super-elastic slider system and the second plate of the super-elastic slider system; and at least one shape metal alloy extending between the first plate of the super elastic slider system and the second plate of the super-elastic slider system and exterior of the pier, the at least one shape metal alloy element having an initial shape, the at least one shape metal alloy element including:

a first terminating end secured to a first hinging ring; and a second terminating end secured to a second hinging ring.

9. The system of claim 8, wherein the first plurality of hinging rings including the first hinging ring and the second hinging ring.

10. The system of claim 8, wherein:

the first plurality of hinging rings including the first hinging ring; and the second plurality of hinging rings including the second hinging ring.

11. The system of claim 8, wherein the at least one shape metal alloy element extending between the first plate of the super-elastic slider system and the second plate of the super-elastic slider system includes the at least one shape metal alloy element extending through at least one of the first plurality of hinging rings.

12. The system of claim 8, wherein the at least one shape metal alloy element extending between the first plate of the super-elastic slider system and the second plate of the super-elastic slider system includes the at least one shape metal alloy element extending through at least one of the first plurality of hinging rings and at least one of the second plurality of hinging rings.

13. A method of isolating a building structure from a ground movement comprising:

centering the building structure in a first position relative to a building foundation;

securing a first plate of a super-elastic slider system to the building foundation;

securing a second plate of the super-elastic slider system to the building structure, wherein the super-elastic slider system includes a pier extending between the first plate and the second plate of the super-elastic slider system and at least one shape metal alloy element extending exterior of the pier and between the first plate of the super-elastic system and the second plate of the super-elastic slider system, the at least one shape metal alloy element having an initial shape, wherein the at least one shape metal alloy element includes a first enclosed loop end secured to a first hinging ring and a second enclosed loop end secured to a second hinging ring, the first hinging ring is secured to the first plate of the super-elastic slider system and the second hinging ring is secured to the second plate of the super-elastic slider system;

moving the building foundation during the ground movement;

shifting the building structure in at least one of a horizontal direction and a vertical direction to a second position relative to the building foundation, including flexing the at least one shape metal alloy element to a secondary shape; and automatically recentering the building structure to the first position relative to the building foundation including retracting the at least one flexed shape metal alloy element to the initial shape.

14. The method of claim 13, wherein the at least one shape metal alloy element includes multiple shape metal alloy elements.

15. The method of claim 14, wherein the multiple shape metal alloy elements are arrayed in two parallel planes.

16. The method of claim 14, wherein the multiple shape metal alloy elements are arrayed in at least one first plane and at least one second plane perpendicular to and intersecting with the at least one first plane.

17. The method of claim 13, wherein the at least one shape metal alloy element extends through two or more intersecting perpendicular planes.

18. The method of claim 13, wherein the at least one shape metal alloy element extends through and between two or more parallel planes.

19. The method of claim 13, wherein the at least one shape metal alloy element extends along an intersection of two intersecting perpendicular planes.

20. The method of claim 13, wherein the at least one shape metal alloy element extends diagonally across a single plane.

21. The method of claim 13, wherein the at least one shape metal alloy element extends along a perimeter of a single plane.

22. The method of claim 21, wherein the at least one shape metal alloy element extends along at least two edges of a perimeter of a single plane.

* * * * *